US007334443B2

(12) United States Patent
Meekma et al.

(10) Patent No.: US 7,334,443 B2
(45) Date of Patent: Feb. 26, 2008

(54) RADIO FREQUENCY ELECTRONIC LOCK

(75) Inventors: Glenn Meekma, Menomonee Falls, WI (US); Jesse Marcelle, Franklin, WI (US); Gary Burmesch, Port Washington, WI (US); Martyn S. Nunuparov, Moscow (RU)

(73) Assignee: Master Lock Company LLC, Oak Creek, WI (US)

( * ) Notice: Subject to any disclaimer, the term of this patent is extended or adjusted under 35 U.S.C. 154(b) by 0 days.

(21) Appl. No.: 10/373,674

(22) Filed: Feb. 24, 2003

(65) Prior Publication Data

US 2004/0035160 A1 Feb. 26, 2004

Related U.S. Application Data

(60) Provisional application No. 60/359,082, filed on Feb. 22, 2002.

(51) Int. Cl.
*E05B 49/00* (2006.01)

(52) U.S. Cl. ..... 70/278.7; 70/276; 70/278.2; 307/10.2; 340/5.61

(58) Field of Classification Search ..... 70/395, 70/408, 413, 278.1, 278.2, 278.3, 278.7, 70/275–277, 279.1–284; 307/10.1–10.5; 340/5.61

See application file for complete search history.

(56) References Cited

U.S. PATENT DOCUMENTS 315,186 A 4/1885 Thaxter
480,299 A 8/1892 Voight
491,369 A 2/1893 Moyer et al.
550,111 A 11/1895 Sargent
564,029 A 7/1896 Sargent
3,208,248 A 9/1965 Tornroe
3,343,636 A 9/1967 Donelan et al.
3,527,992 A 9/1970 Bright et al.
3,629,624 A 12/1971 Staudte
3,733,862 A 5/1973 Killmeyer
3,787,812 A 1/1974 Armstrong
3,797,936 A 3/1974 Dimitriadis
3,848,229 A 11/1974 Perron et al.
3,851,315 A 11/1974 Hedin
3,871,944 A 3/1975 Dominguez-Burguette
4,144,523 A 3/1979 Kaplit
4,177,657 A 12/1979 Aydin (Continued)

FOREIGN PATENT DOCUMENTS

DE 198 56 292 7/1999

(Continued)

OTHER PUBLICATIONS

Allen, Sam. Locks & Alarms. 1984. 66-67. TAB Books Inc., Blue Ridge Summit, PA.

(Continued)

*Primary Examiner*—Suzanne Dino Barrett
(74) *Attorney, Agent, or Firm*—Calfee, Halter & Griswold LLP

(57) ABSTRACT

A radio frequency ("RF") electronic lock and a method of its operation are described. Also described is a programming key which may be used in connection with such a lock. It has several embodiments, including without limitations a mortise cylinder lock, a padlock, and a lever lock.

16 Claims, 20 Drawing Sheets

U.S. PATENT DOCUMENTS 4,200,227 A 4/1980 Lemelson
4,209,782 A 6/1980 Donath et al.
4,257,030 A 3/1981 Bruhin
4,326,124 A 4/1982 Faude
4,336,699 A 6/1982 Green
4,393,967 A 7/1983 Cuomo et al.
4,484,462 A 11/1984 Berkowitz
4,534,194 A 8/1985 Aydin
4,562,712 A 1/1986 Wolter
4,616,491 A 10/1986 Genest
4,620,088 A 10/1986 Flies
4,633,687 A 1/1987 Fane
4,656,850 A 4/1987 Tabata
4,659,915 A 4/1987 Flies
4,663,952 A 5/1987 Gellhard
4,686,358 A 8/1987 Seckiner et al.
4,712,398 A 12/1987 Clarkson et al.
4,723,427 A 2/1988 Oliver
4,727,369 A 2/1988 Rode et al.
4,732,022 A 3/1988 Oliver
4,744,021 A * 5/1988 Kristy ..... 700/12
4,754,185 A 6/1988 Gabriel et al.
4,789,859 A 12/1988 Clarkson et al.
4,798,068 A * 1/1989 Nakauchi ..... 70/276
4,815,307 A 3/1989 Widen
4,823,575 A 4/1989 Florian et al.
4,848,115 A * 7/1989 Clarkson et al. ..... 70/276
4,854,143 A 8/1989 Corder
5,891,636 A 1/1990 Reiker
4,901,545 A 2/1990 Bacon
4,912,460 A 3/1990 Chu
4,916,927 A * 4/1990 O'Connell et al. ..... 70/276
4,936,122 A 6/1990 Osada
4,956,984 A 9/1990 Chi-Cheng
5,003,801 A 4/1991 Stinar
5,038,023 A 8/1991 Saliga
5,068,566 A 11/1991 Culp
5,083,122 A 1/1992 Clark
5,089,692 A 2/1992 Thonnesson
5,131,038 A 7/1992 Puhl et al.
5,140,317 A 8/1992 Hyatt et al.
5,218,188 A 6/1993 Hanson
5,229,679 A 7/1993 Higuchi et al.
5,235,225 A 8/1993 Colgate et al.
5,239,222 A 8/1993 Higuchi
5,245,329 A 9/1993 Gokcebay et al.
5,250,137 A 10/1993 Arami et al.
5,262,695 A 11/1993 Kuwano et al.
5,337,588 A 8/1994 Chhatwal
5,351,042 A * 9/1994 Aston ..... 340/5.61
5,367,295 A 11/1994 Gokcebay et al.
5,378,954 A 1/1995 Higuchi et al.
5,384,682 A 1/1995 Watanabe et al.
5,430,597 A 7/1995 Bagepalli
5,448,124 A 9/1995 Higuchi et al.
5,469,727 A 11/1995 Spahn
5,474,348 A 12/1995 Palmer
5,487,289 A 1/1996 Otto, III et al.
5,507,162 A 4/1996 Chhatwal
5,523,639 A 6/1996 Okamoto et al.
5,525,642 A 6/1996 Cipriano et al.
5,534,740 A 7/1996 Higuchi et al.
5,540,069 A 7/1996 Muller et al.
5,541,465 A 7/1996 Higuchi et al.
5,542,274 A * 8/1996 Thordmark et al. ..... 70/495
5,552,654 A 9/1996 Konno et al.
5,552,777 A 9/1996 Gokcebay et al.
5,564,294 A 10/1996 Chen
5,600,290 A * 2/1997 Anderson, II ..... 333/252
5,608,298 A 3/1997 Frolov
5,614,703 A 3/1997 Martin et al.
5,620,071 A 4/1997 Ishikawa et al.
5,629,578 A 5/1997 Winzer et al.
5,631,514 A 5/1997 Garcia et al.
5,632,168 A * 5/1997 Yano ..... 70/278.3
5,701,828 A 12/1997 Benore et al.
5,708,308 A 1/1998 Katayama
5,708,319 A 1/1998 Ban
5,717,147 A 2/1998 Basch et al.
5,726,509 A 3/1998 Benecke et al.
5,732,579 A * 3/1998 D'Hont et al. ..... 70/278.2
5,749,253 A 5/1998 Glick
5,768,925 A * 6/1998 Ozawa et al. ..... 70/408
5,789,843 A 8/1998 Higuchi et al.
5,791,170 A 8/1998 Officer
5,808,383 A 9/1998 Kostov et al.
5,818,148 A 10/1998 Shiomi
5,836,187 A * 11/1998 Janssen et al. ..... 70/252
5,839,305 A 11/1998 Aston
5,839,306 A 11/1998 Nunuparov
5,841,361 A 11/1998 Hoffman
5,852,944 A * 12/1998 Collard et al. ..... 70/278.7
5,857,365 A 1/1999 Armstrong
5,869,916 A 2/1999 Suzuki et al.
5,898,254 A 4/1999 Kostov et al.
5,903,428 A 5/1999 Grimard et al.
5,908,334 A 6/1999 Chen
6,000,609 A 12/1999 Gokcebay et al.
6,038,895 A * 3/2000 Menke et al. ..... 70/278.1
6,116,066 A 9/2000 Gartner
6,160,319 A * 12/2000 Marougi et al. ..... 307/10.5
6,169,377 B1 * 1/2001 Bryde et al. ..... 315/294
6,181,025 B1 * 1/2001 McConnell et al. ..... 307/10.2
6,227,020 B1 5/2001 Lerchner
6,244,084 B1 6/2001 Warmack
6,351,206 B1 * 2/2002 Schweiger et al. ..... 340/5.64
6,367,299 B1 * 4/2002 Janssen et al. ..... 70/278.3
6,374,652 B1 * 4/2002 Hwang ..... 70/277
6,374,653 B1 4/2002 Gokcebay et al.
6,382,003 B1 * 5/2002 Watanuki et al. ..... 70/252
6,519,987 B1 * 2/2003 Weyerstall ..... 70/257
6,655,817 B2 * 12/2003 Devlin et al. ..... 362/233
2001/0005998 A1 7/2001 Imedio Ocana
2002/0189307 A1 12/2002 Gokcebay et al.
2003/0029210 A1 * 2/2003 Budzynski et al. ..... 70/278.1

FOREIGN PATENT DOCUMENTS

EP 0701036 A1 3/1996
GB 2 174 452 11/1986
GB 2 239 673 10/1991
WO WO9427012 A1 11/1994
WO WO 03/058016 7/2003

OTHER PUBLICATIONS

Southerland, Randy. A School Created by Disney. Access Control & Security Systems Integration. Jun. 1999. Intertec Publishing Corp., Atlanta, GA.
EM Microelectronic-Marin SA. Read Only Contactless Identification Device. 2000. EM Microelectronic-Marin S.A., Marin, Switzerland.
Dallas Semiconductor. Information at the Touch of a Button. www.iButton.com. Dallas Semiconductor Corporation, Dallas, Texas.
Dallas Semiconductor. 50 Ways to Touch Memory. 1994. 1,2, 20,22. Dallas Semiconductor Corporation, Dallas, Texas.
OSI Security Devices Price Book 6 (Effective Aug. 15, 2000), pp. 1-28.
Institute for Physical Research & Technology Marlok Information (Sep. 12, 2000), pp. 1-2.
Ilco Unican-Product Information-Solitaire Plus (Sep. 12, 2000), pp. 1-3.
Ilco Unican-Product Information-Solitaire 1000 (Sep. 25, 2000), pp. 1-4.

Ilco Unican US & International Price List (Effective Aug. 1, 2000), 44 pgs.
Ilco Unican SolitairePROX, 4 pgs.
Videx TouchAccess 300 Access Control System, 2 pgs.
Videx Access Control Systems Retail Pricing (Mar. 26, 2001), 4 pgs.
Videx CyberLock Intelligent Access Control System, 4 pgs.
Cyberlock is Now Available in an IC Core, Locksmith Ledger Mar. 2001, pp. 12, 14, 16, 18.
Total Control from Mul-T-Lock Elite.
ERA Keysolve Access Control System, 4 pgs.
The Flexible Locking System With No Limitations, 5 pgs.
What's New Latest Product News, Videx Wave Guard 2400 and Mul-T-Lock Elite, 1 pg.
Winkhaus (UK), news 'n' FACTS, Introducing The Evolutionary Winkhaus Blue Chip Cylinder, 2 pgs.
RFID Door Lock Just-A-Key 002, 2 pgs.
Medeco High Security Locks, Electronic Access Control, ElectroMechanical Products U.S. List Price Book 2000, pp. 1-13.
Medeco High Security Locks, SiteKey (1997/2000), 5 pgs.
SiteLine Single Door Controller by Medeco (1998), 8 pgs.
Intellikey Genius At Your Fingertips, 8 pgs.
EBM Inc. Catalogue Products/Services (Sep. 14, 2000), pp. 3, 13, 14, 15, 16.
Price List of Intellikey Products, 2 pgs.
The Power of Intelligent Keys, Products, System 1000 (Apr. 19, 2000), pp. 1-3.
Intellikey Product Gallery, Products, Intelligent Key (Apr. 19, 2000), pp. 1-2.
Intellikey Product Gallery, Products, Intelligent Lock (Apr. 19, 2000), pp. 1-2.
Clark Electronics 2001 Access Control Catalog, pp. 1-86.
Sargent Keypad Family Expansion, 2 pgs.
Winfield MicroKey Security Solutions, Winfield MicroKey Systems (Nov. 3, 1999), pp.1-3.
Winfield MicroKey-Model E600 Mortise Lock Commercial Series, Winfield MicroKey Specifications: Mortise Lock Commercial Series (Nov. 3, 1999), pp. 1-3.
Winfield Model E1000, MicroKey Electronic Tubular Lock, 2 pgs.
Winfield Model E600 MicroKey Electronic Mortise Lock, 2 pgs.
Wireless Technology, Wireless Accesss Integrated Reader Lock-Elite (2001).
Trilogy Prox Locks by Alarm Lock PDL3000 Series (2000), 4 pgs.
Napco Security Group, The 2-Way Universal LCD Keyfob that puts the power of a keypad in your pocket, (Jul. 2000), 2 pgs.
Tay Wae Industrial Co., Ltd. Q & A, 2 pgs.

* cited by examiner

RADIO FREQUENCY ELECTRONIC LOCK

RELATED APPLICATION

This application claims the benefit of U.S. Provisional patent application Ser. No. 60/359,082, filed on Feb. 22, 2002, the entire disclosure of which is fully incorporated herein by reference.

BACKGROUND AND SUMMARY OF THE INVENTION

The present invention pertains to a radio frequency ("RF") electronic lock, and a method of its operation. It further pertains to a programming key which may be used in connection with such a lock. It has particular use in replacing conventional, mechanical operation lock systems. It has the most beneficial use in large security systems where access through multiple rooms and buildings is centrally monitored.

BRIEF DESCRIPTION OF THE DRAWINGS

The accompanying drawings illustrate embodiments of the invention. These drawings, together with the written description of the invention given below, serve to illustrate the principles of this invention.

DETAILED DESCRIPTION OF THE PREFERRED EMBODIMENTS

Figures 1A, 1B, 1C:
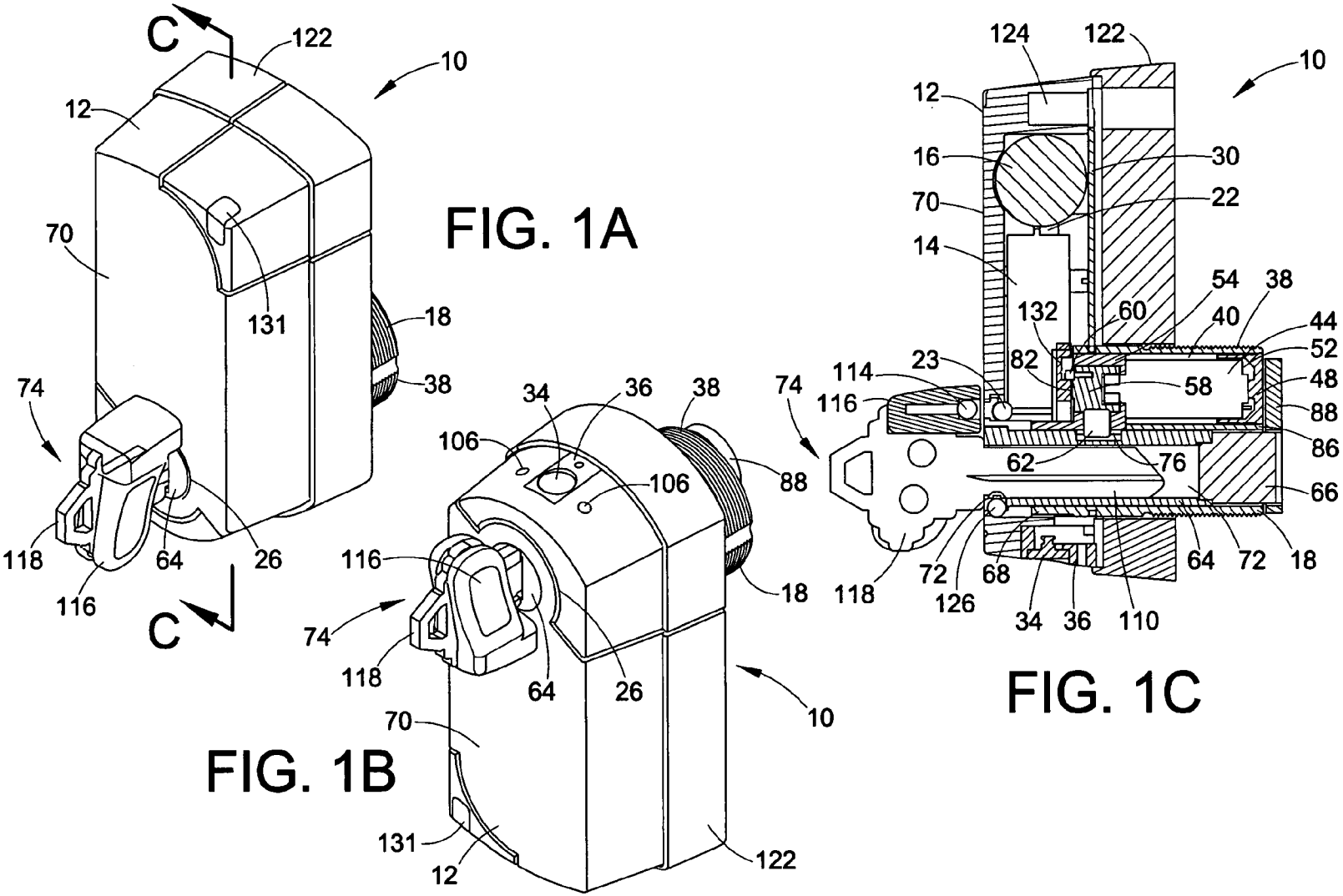
FIG. 1A shows a top perspective view of a first embodiment electronic mortise cylinder lock assembly.
FIG. 1B shows a bottom perspective view of the first embodiment electronic mortise cylinder lock assembly.
FIG. 1C shows a cross-sectional view of the first embodiment electronic mortise cylinder lock assembly, taken along the line C—C in FIG. 1A.
Figure 1D:
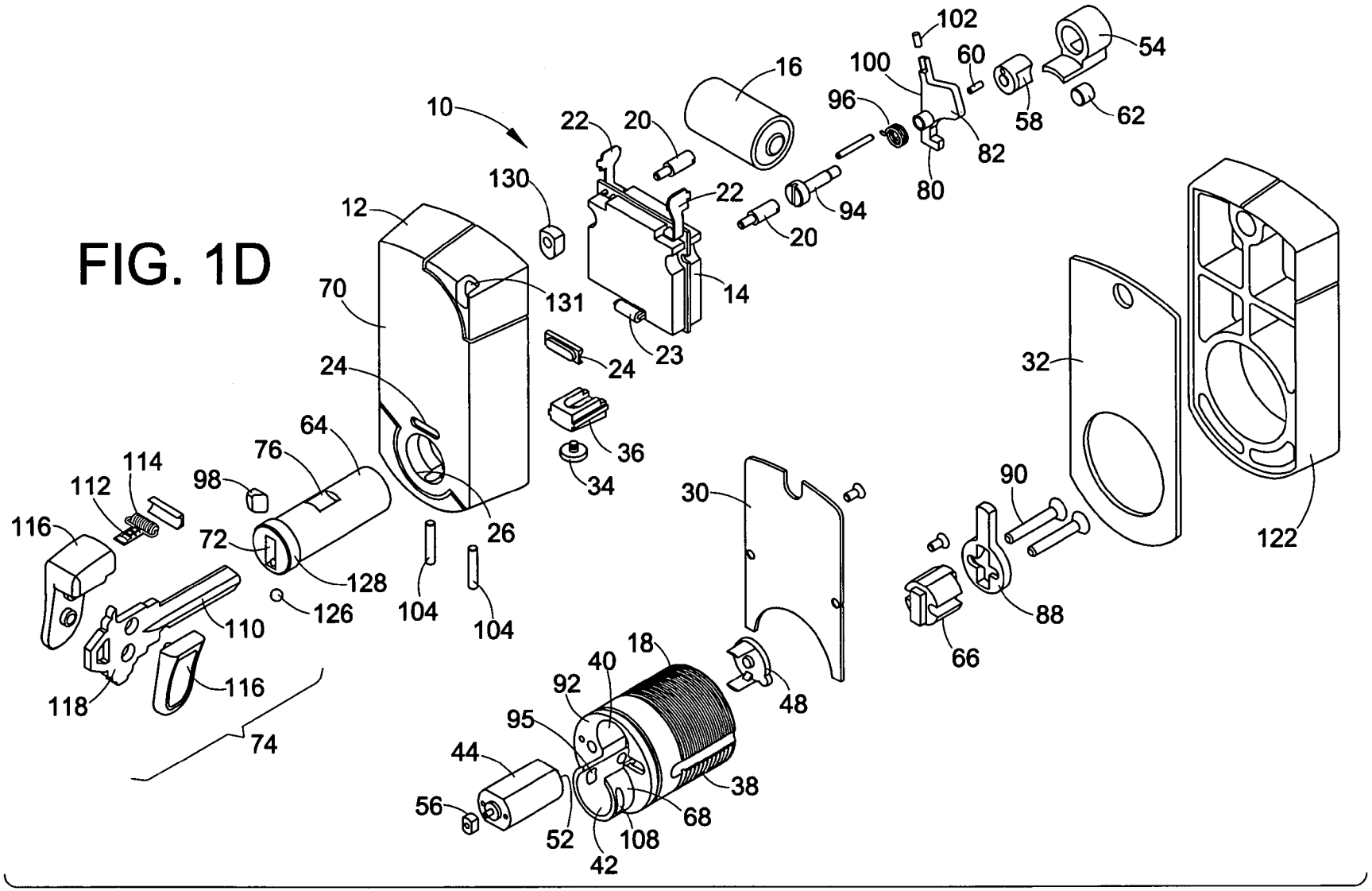
FIG. 1D shows an exploded front, top assembly view of the first embodiment electronic mortise cylinder lock assembly.
Figure 1E:
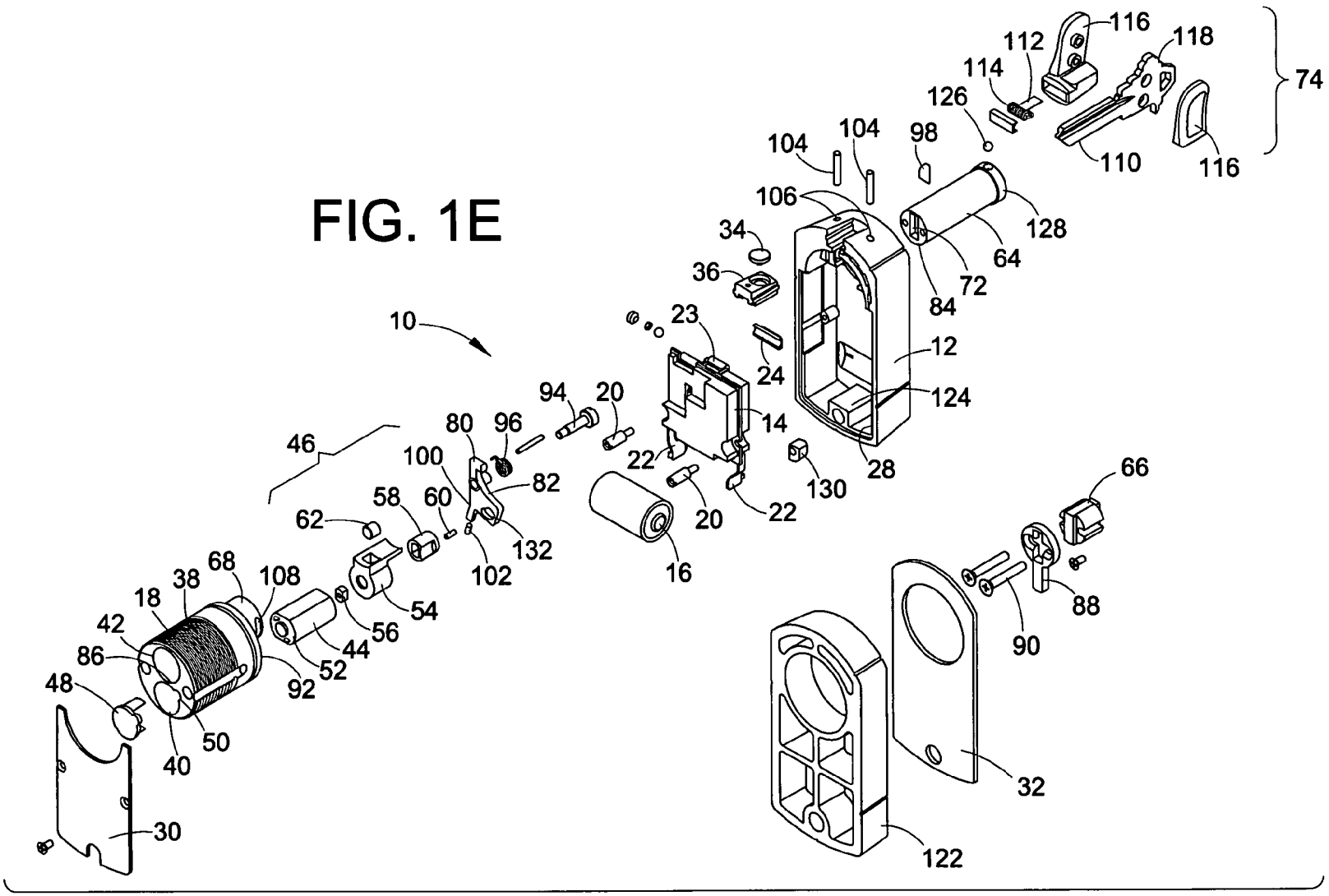
FIG. 1E shows an exploded rear, bottom assembly view of the first embodiment electronic mortise cylinder lock assembly.
Figure 2C:
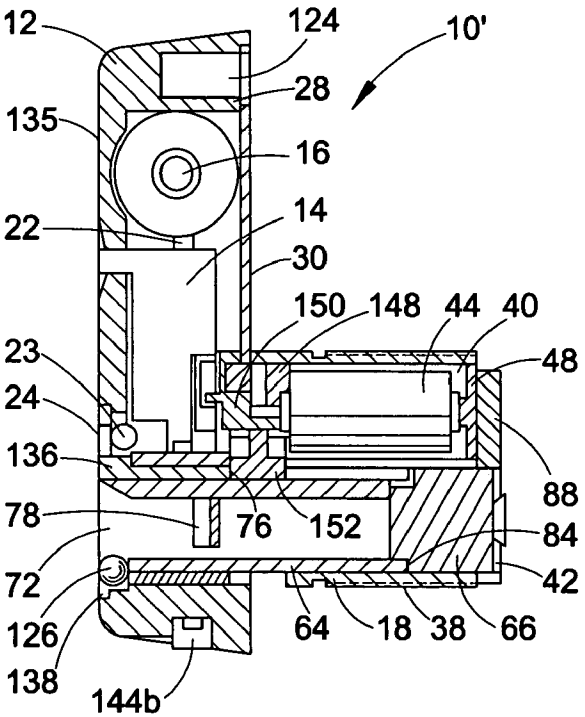
FIG. 2C shows a cross-sectional view of the second embodiment electronic mortise cylinder lock assembly, taken along the line C—C in FIG. 2A.
Figure 2B:
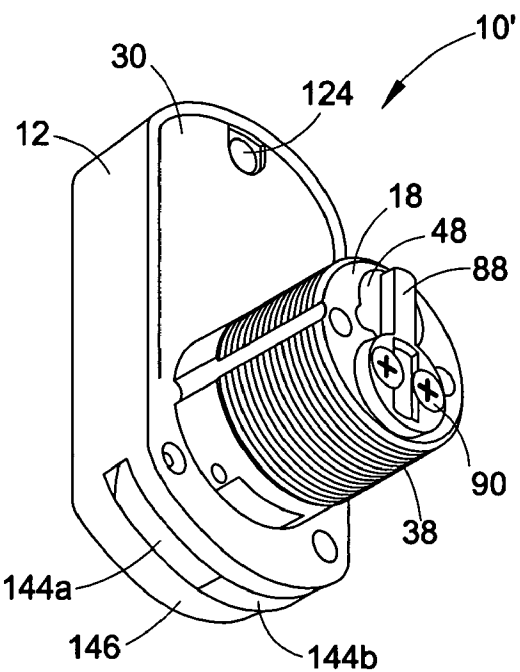
FIG. 2B shows a bottom perspective view of the second embodiment electronic mortise cylinder lock assembly.
Figure 2A:
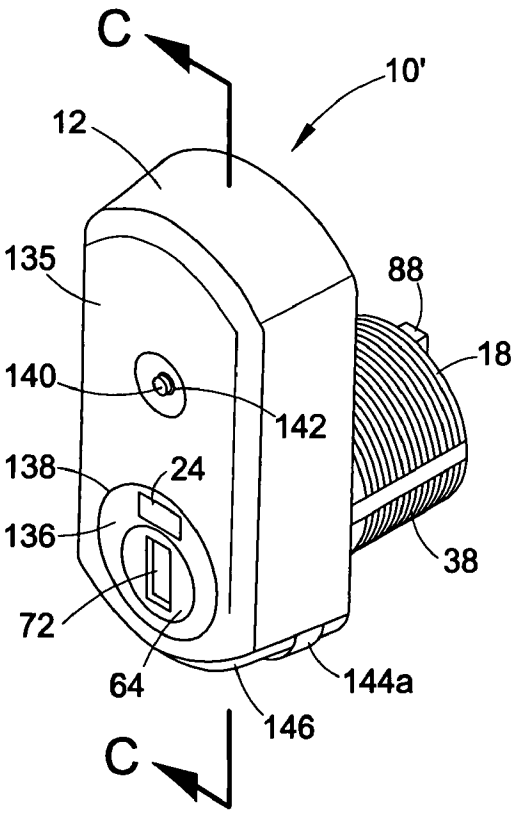
FIG. 2A shows a top perspective view of a second embodiment electronic mortise cylinder lock assembly.
Figure 2D:
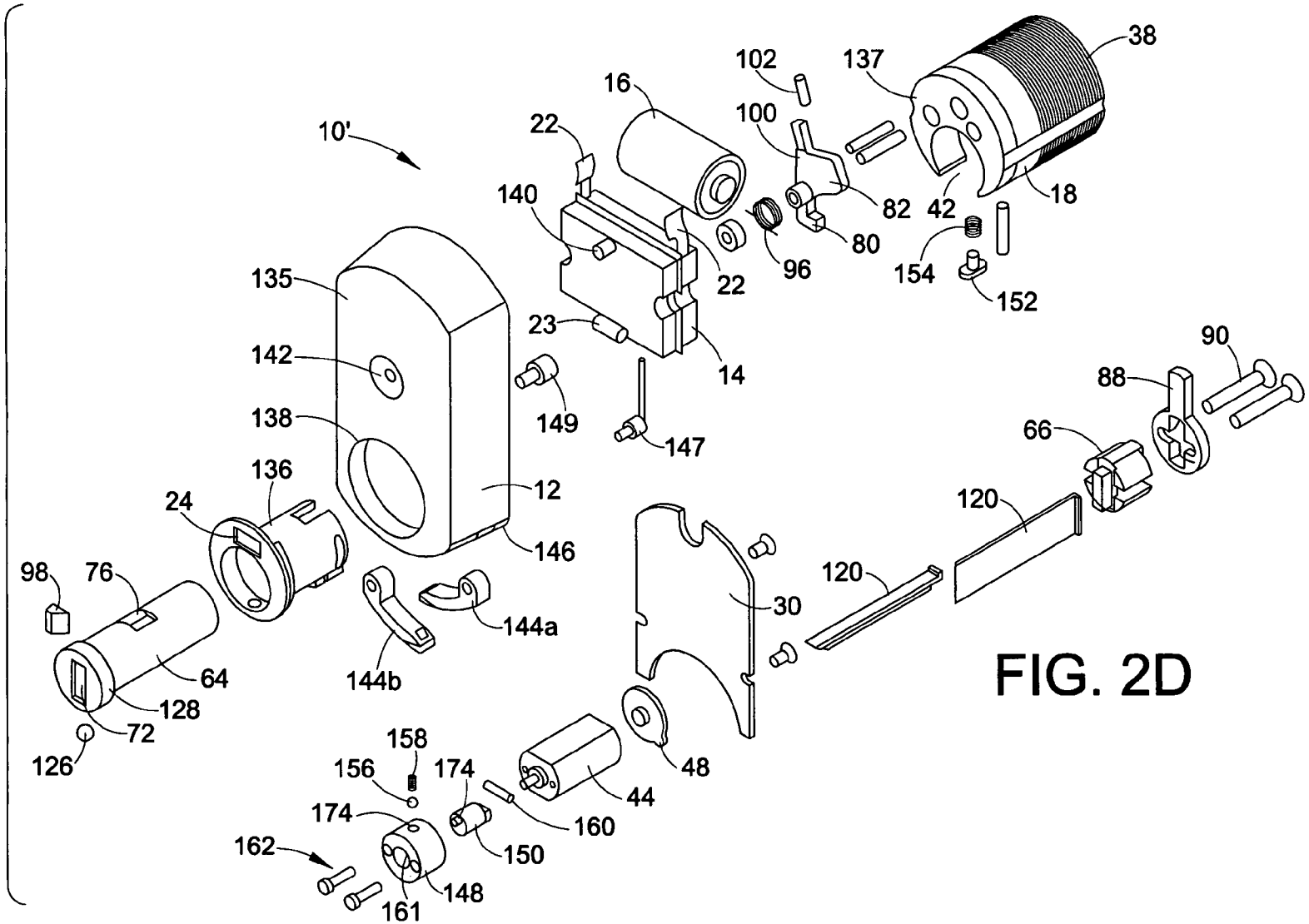
FIG. 2D shows an exploded front, top assembly view of the second embodiment electronic mortise cylinder lock assembly.
Figure 2E:
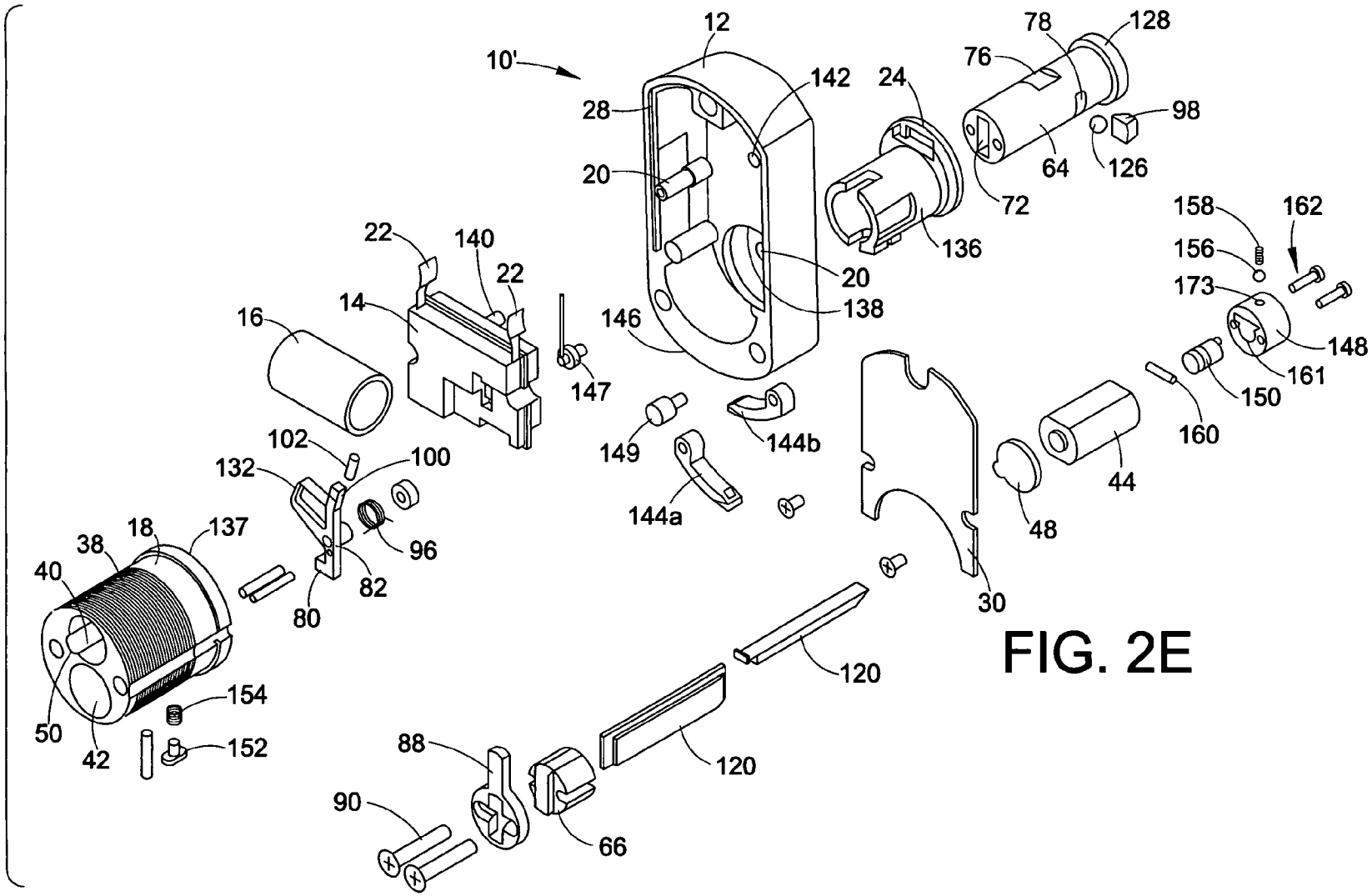
FIG. 2E shows an exploded rear, bottom assembly view of the second embodiment electronic mortise cylinder lock assembly.
Figure 3C:
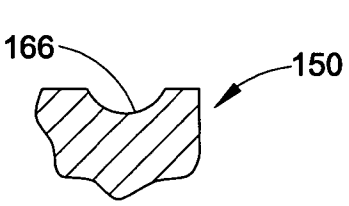
FIG. 3C shows a cross-sectional view of the blocker used in the second embodiment electronic mortise cylinder lock assembly, taken along the line C—C in FIG. 3A.
Figure 3B:
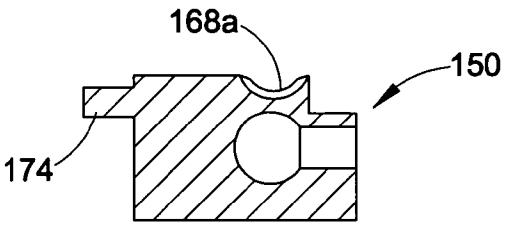
FIG. 3B shows a cross-sectional view of the blocker used in the second embodiment electronic mortise cylinder lock assembly, taken along the line B—B in FIG. 3G.
Figure 3A:
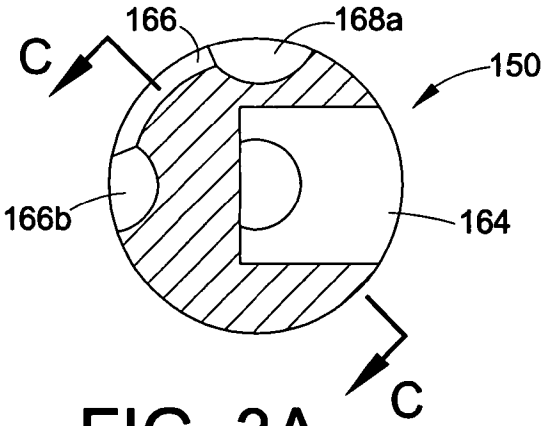
FIG. 3A shows a cross-sectional view of the blocker used in the second embodiment electronic mortise cylinder lock assembly, taken along the line A—A in FIG. 3H.
Figure 3D:
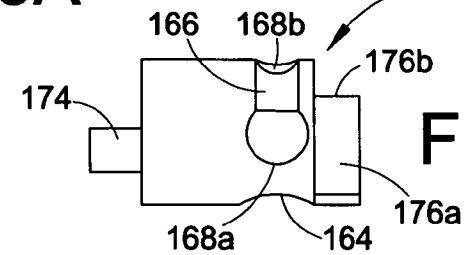
FIG. 3D shows a top perspective view of the blocker used in the second embodiment electronic mortise cylinder lock assembly.
Figure 3G:
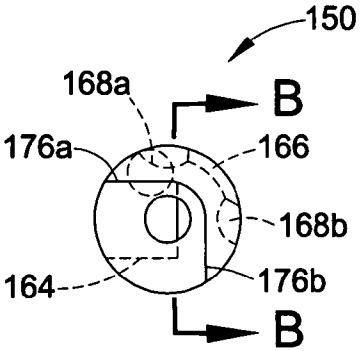
FIG. 3G shows a front perspective view of the blocker used in the second embodiment electronic mortise cylinder lock assembly, with broken lines showing features hidden by that view.
Figure 3H:
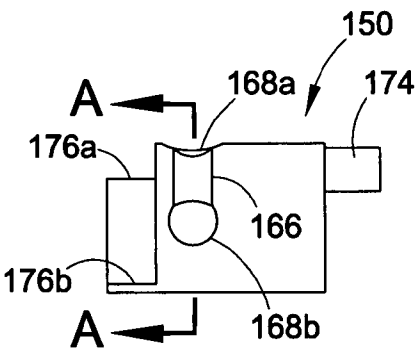
FIG. 3H shows a side perspective view of the blocker used in the second embodiment electronic mortise cylinder lock assembly, with broken lines showing features hidden by that view.
Figure 3F:
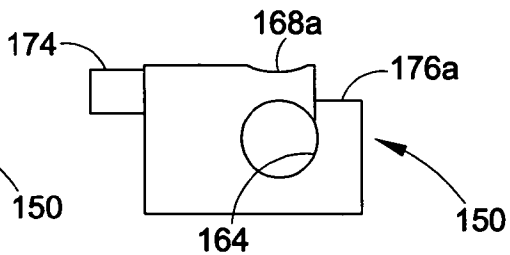
FIG. 3F shows a side perspective view of the blocker used in the second embodiment electronic mortise cylinder lock assembly, with broken lines showing features hidden by that view.
Figure 3E:
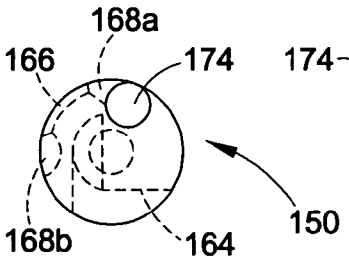
FIG. 3E shows a rear perspective view of the blocker used in the second embodiment electronic mortise cylinder lock assembly, with broken lines showing features hidden by that view.
Figure 4A:
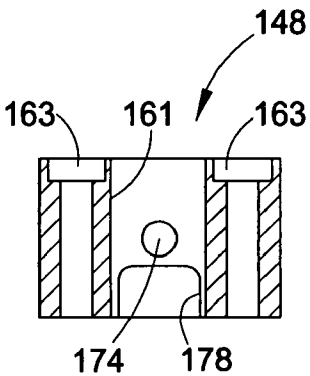
FIG. 4A shows a cross-sectional view of the blocker housing used in the second embodiment electronic mortise cylinder lock assembly, taken along the line A—A in FIG. 4B.
Figure 4B:
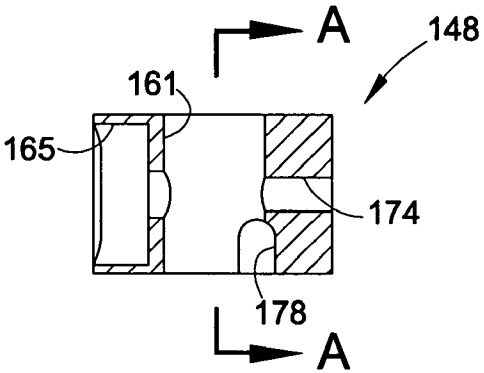
FIG. 4B shows a cross-sectional view of the blocker housing used in the second embodiment electronic mortise cylinder lock assembly, taken along the line B—B in FIG. 4E.
Figure 4C:
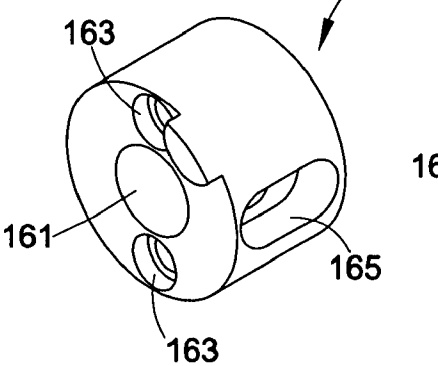
FIG. 4C shows a perspective view of the blocker housing used in the second embodiment electronic mortise cylinder lock assembly.
Figure 4D:
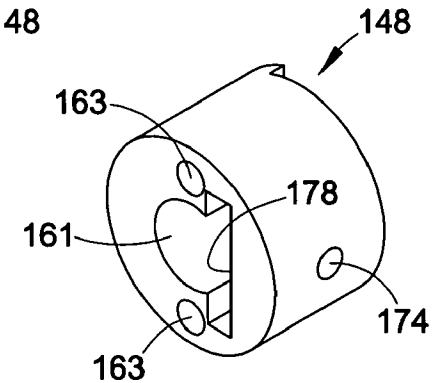
FIG. 4D shows a perspective view of the blocker housing used in the second embodiment electronic mortise cylinder lock assembly.
Figure 4F:
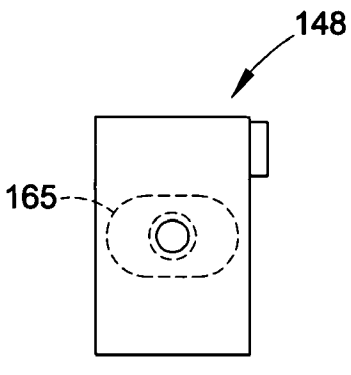
FIG. 4F shows a side perspective view of the blocker housing used in the second embodiment electronic mortise cylinder lock assembly, with broken lines showing features hidden by that view.
Figure 4E:
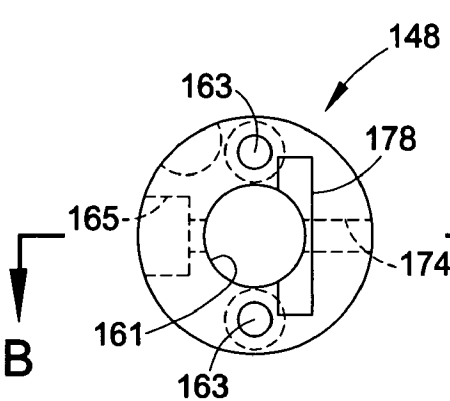
FIG. 4E shows a front perspective view of the blocker housing used in the second embodiment electronic mortise cylinder lock assembly, with broken lines showing features hidden by that view.
Figure 4G:
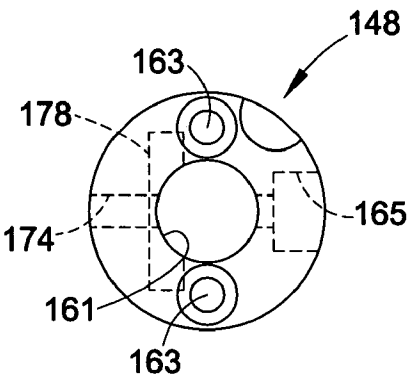
FIG. 4G shows a rear perspective view of the blocker housing used in the second embodiment electronic mortise cylinder lock assembly, with broken lines showing features hidden by that view.
Figure 4H:
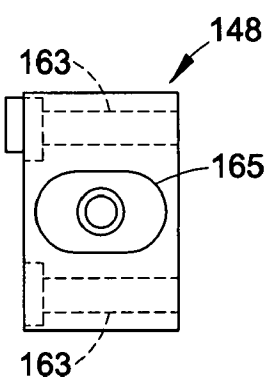
FIG. 4H shows a side perspective view of the blocker housing used in the second embodiment electronic mortise cylinder lock assembly, with broken lines showing features hidden by that view.
Figure 5A:
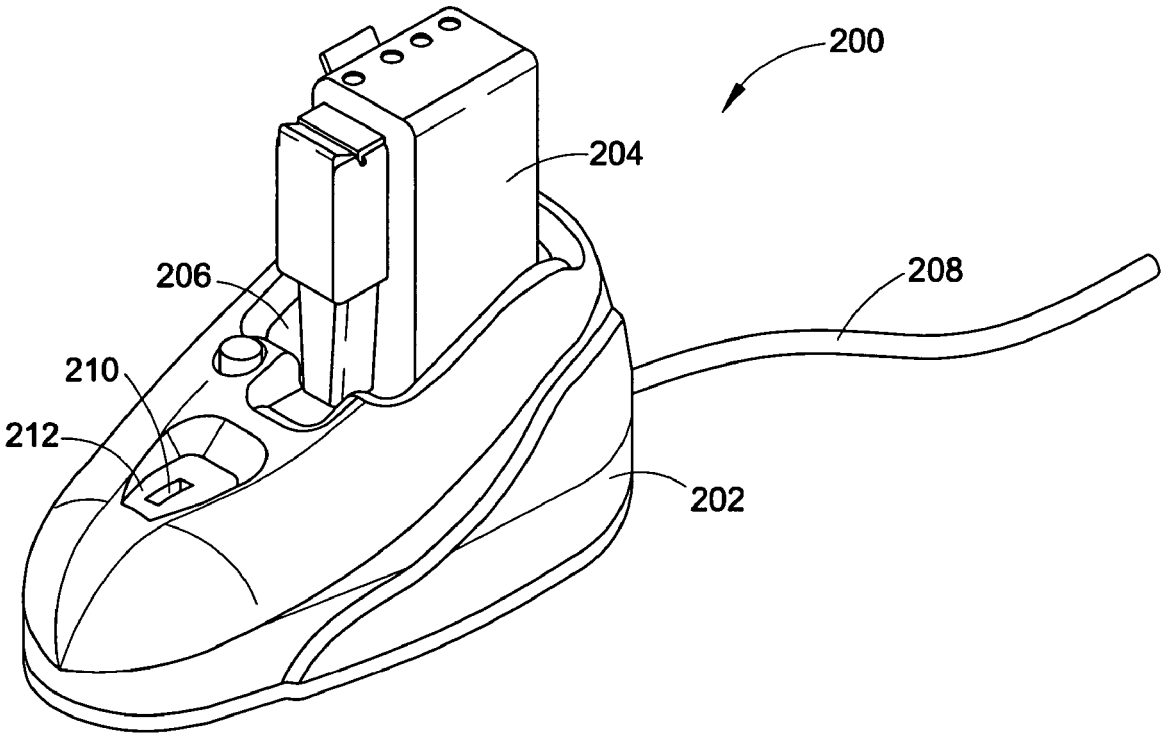
FIG. 5A shows a perspective view of a programming key assembly.
Figure 5B:
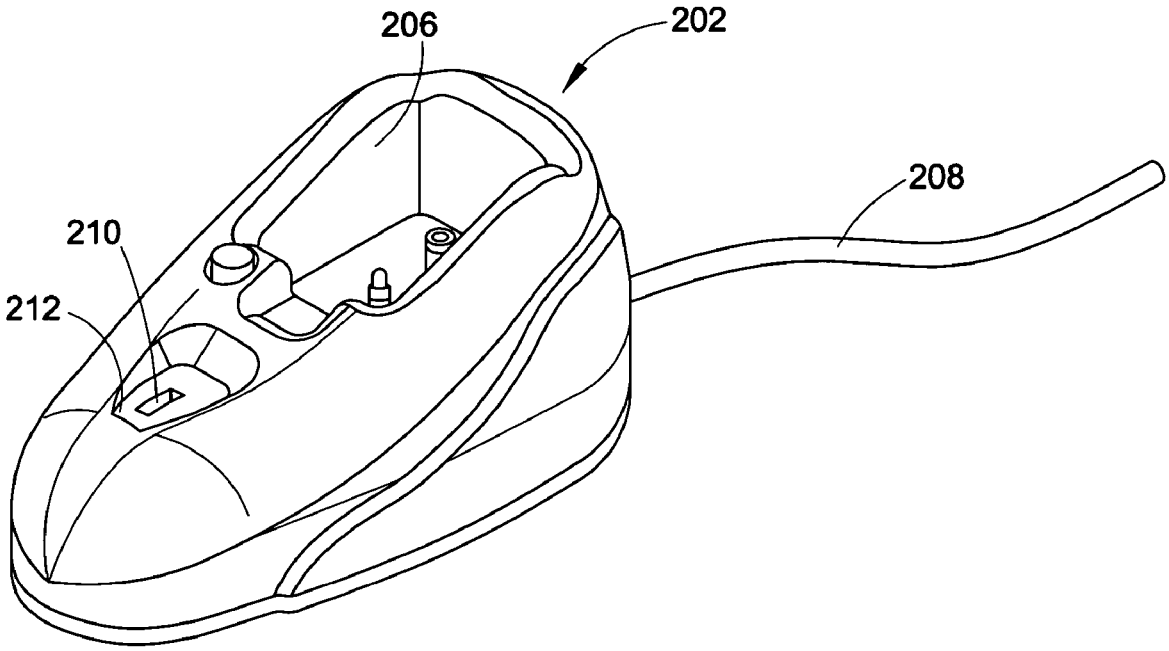
FIG. 5B shows a perspective view of a base portion used in a programming key assembly.
Figure 5D:
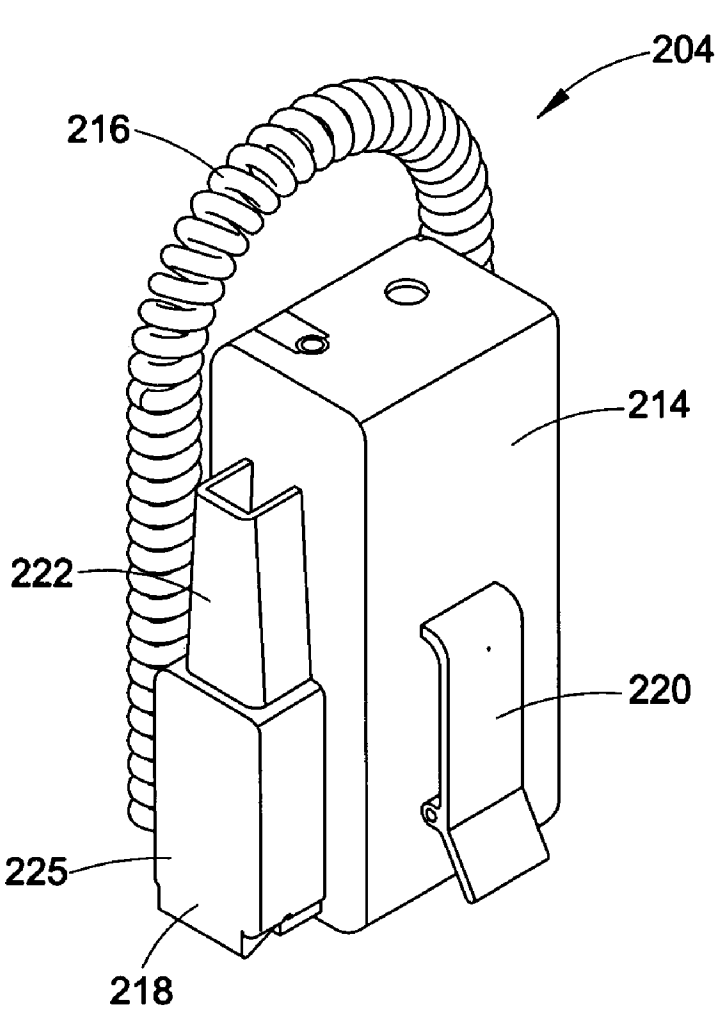
FIGS. 5C and 5D show perspective views of a key unit used in a programming key assembly.
Figure 5C:
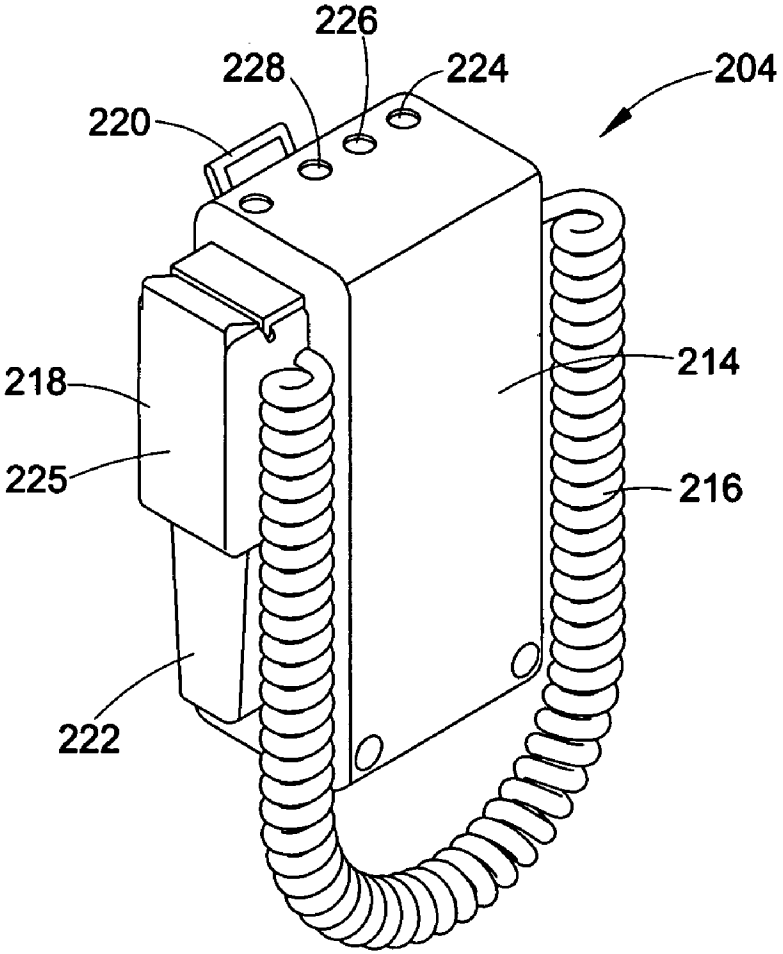
Figure 5E:
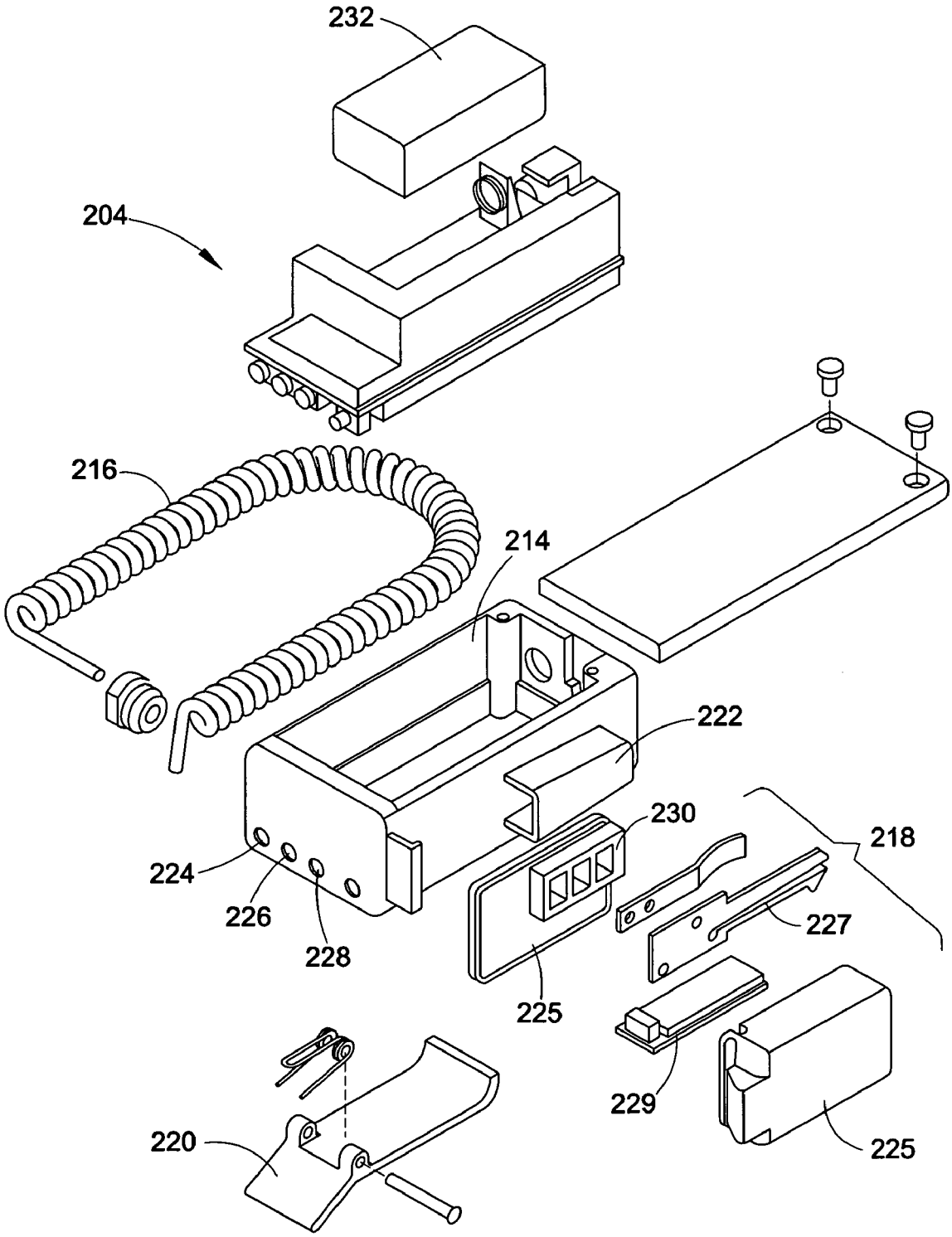
FIG. 5E shows an exploded perspective view of a key unit used in a programming key assembly.
Figure 6A:
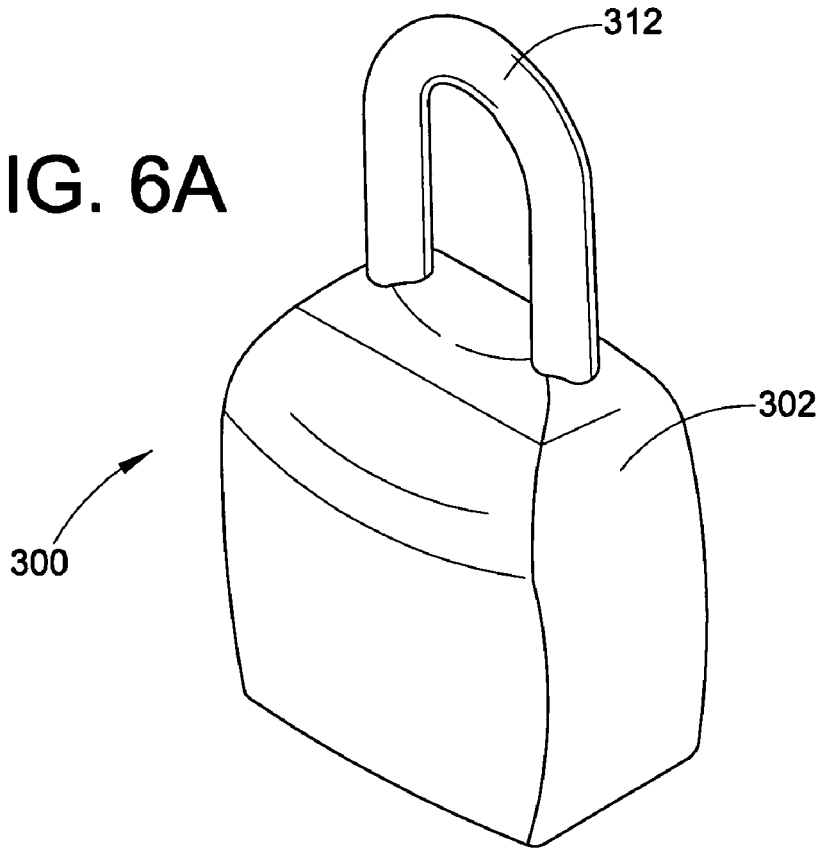
FIG. 6A shows a top perspective view of a padlock embodiment using an electronic locking system.
Figure 6B:
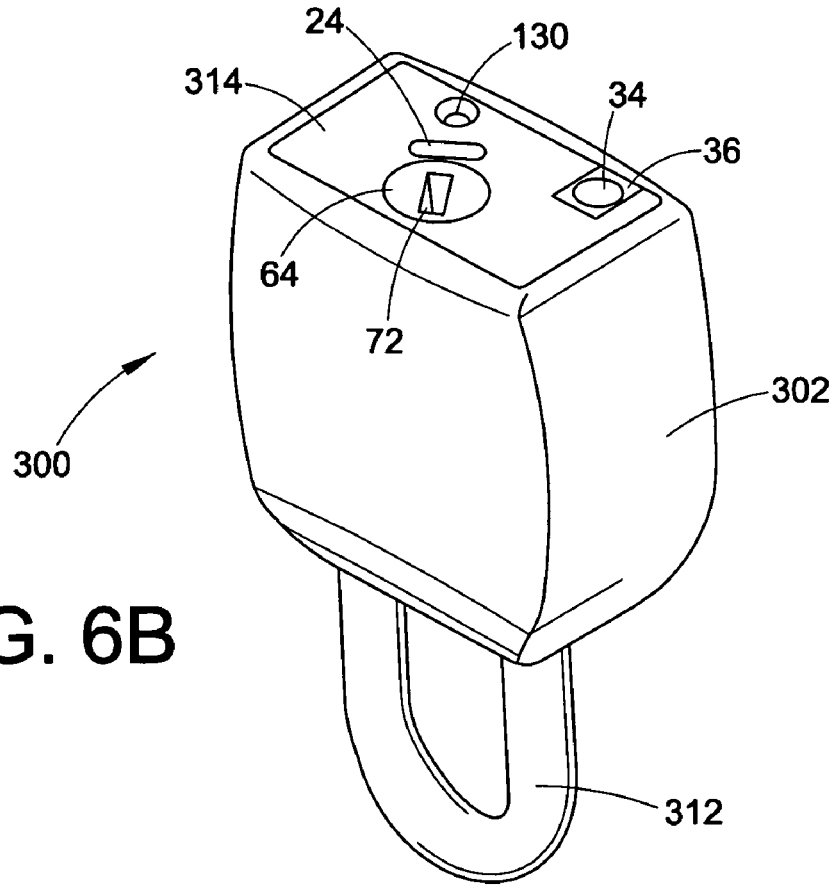
FIG. 6B shows a bottom perspective view of the padlock embodiment of FIG. 6A.
Figure 6C:
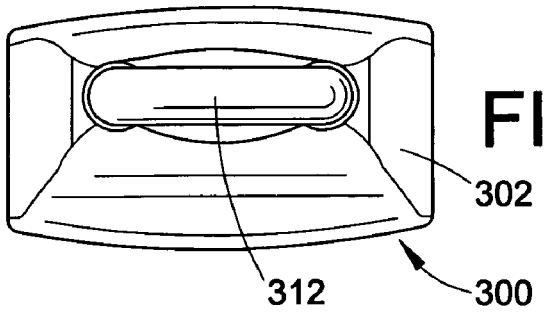
FIG. 6C shows a top view of the padlock embodiment of FIG. 6A.
Figure 6D:
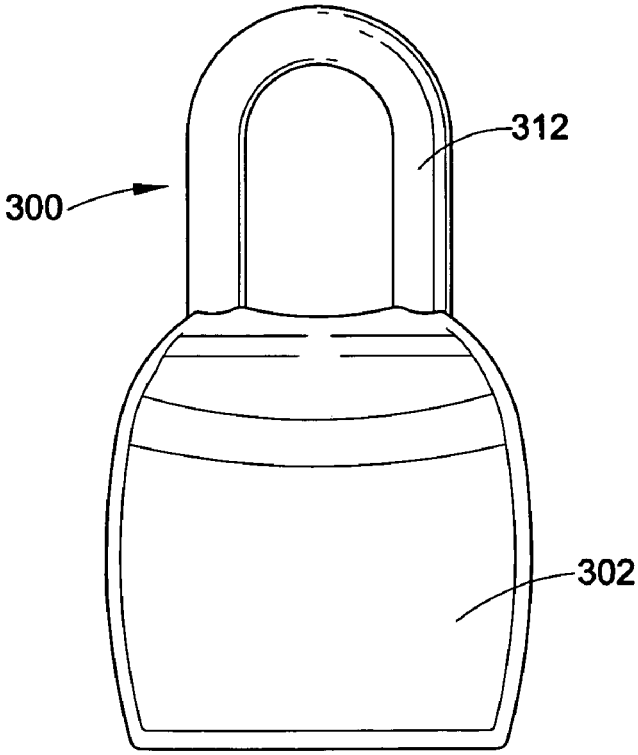
FIG. 6D shows a front view of the padlock embodiment of FIG. 6A.
Figure 6F:
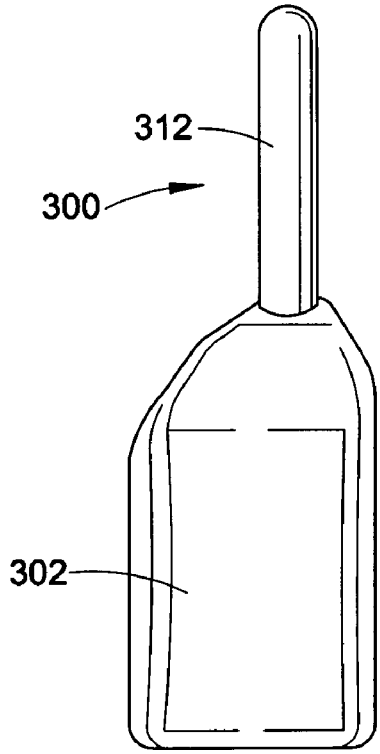
FIG. 6F shows a side view of the padlock embodiment of FIG. 6A.
Figure 6E:
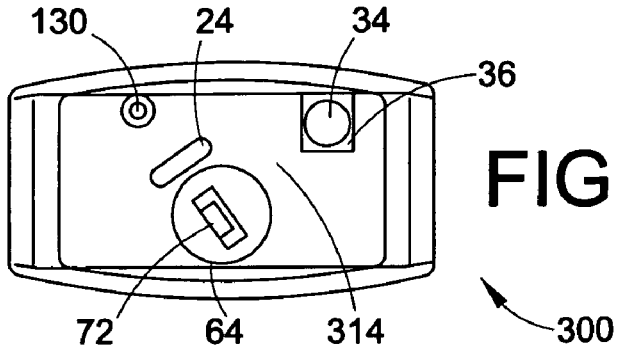
FIG. 6E shows a bottom view of the padlock embodiment of FIG. 6A.
Figure 6G:
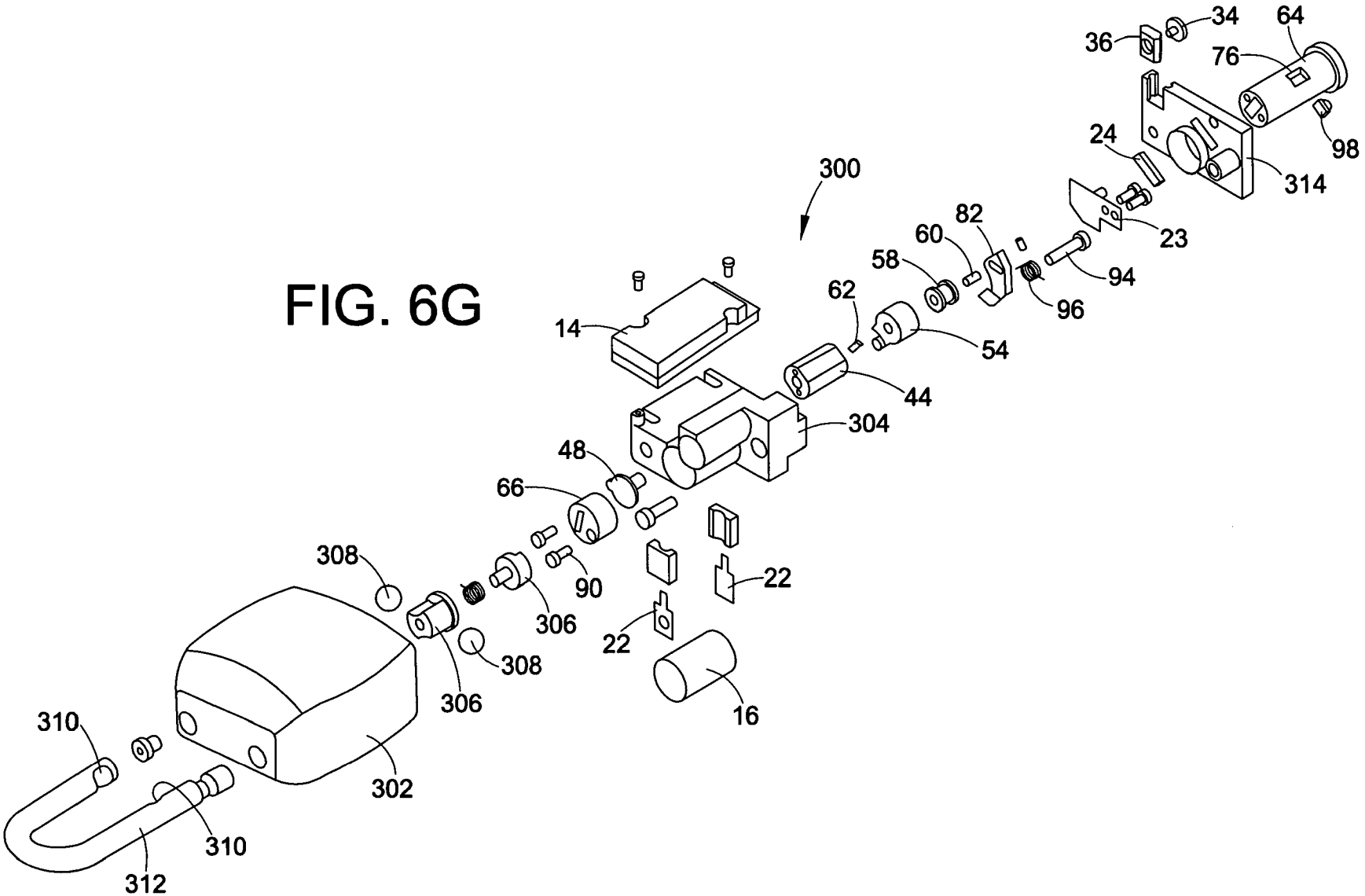
FIG. 6G shows an exploded front, bottom assembly view of the padlock embodiment of FIG. 6A.
Figure 6H:
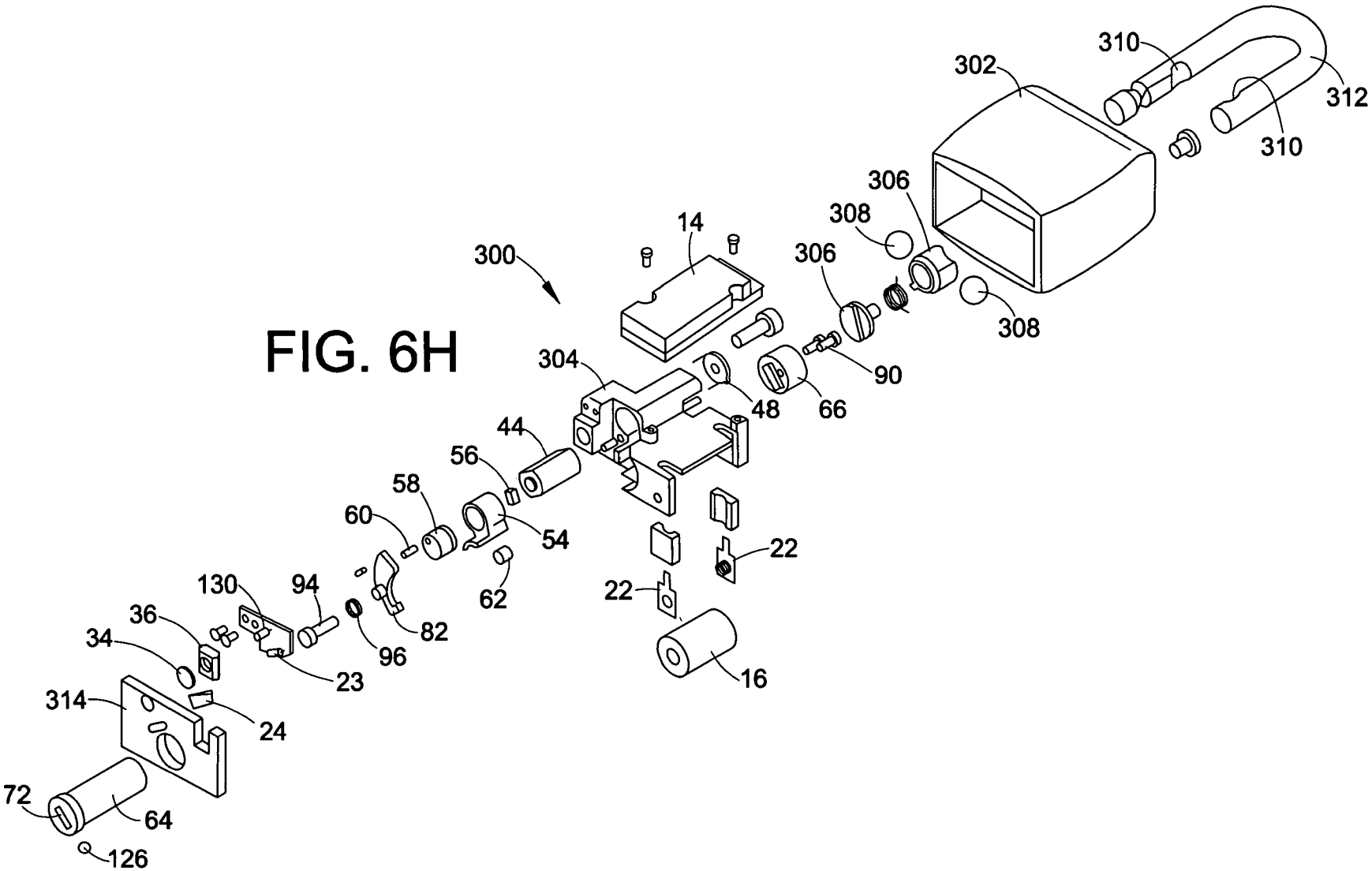
FIG. 6H shows an exploded front, top assembly view of the padlock embodiment of FIG. 6A.
Figure 7A:
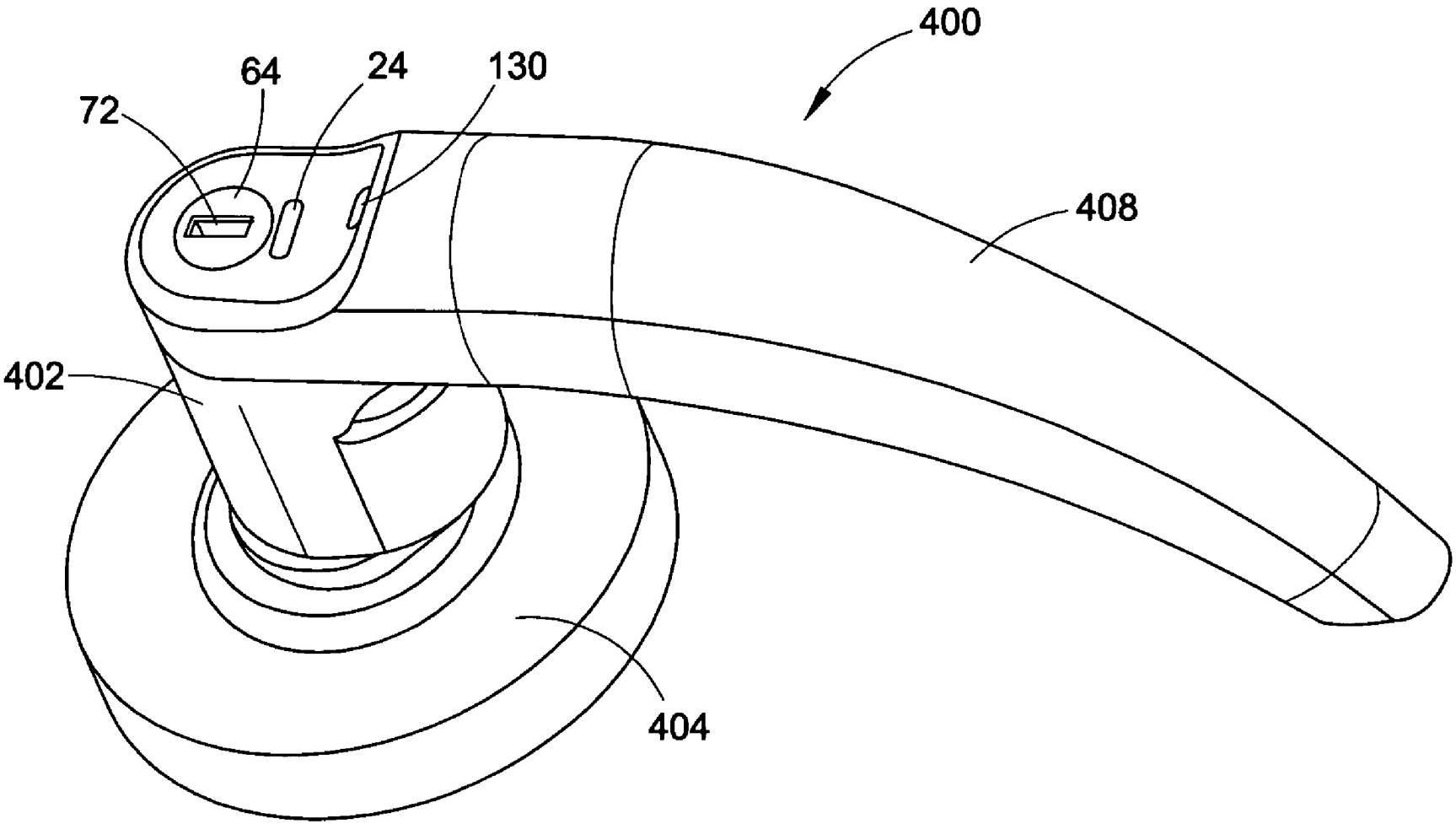
FIG. 7A shows a perspective view of a lever lock embodiment using an electronic locking system.
Figure 7B:
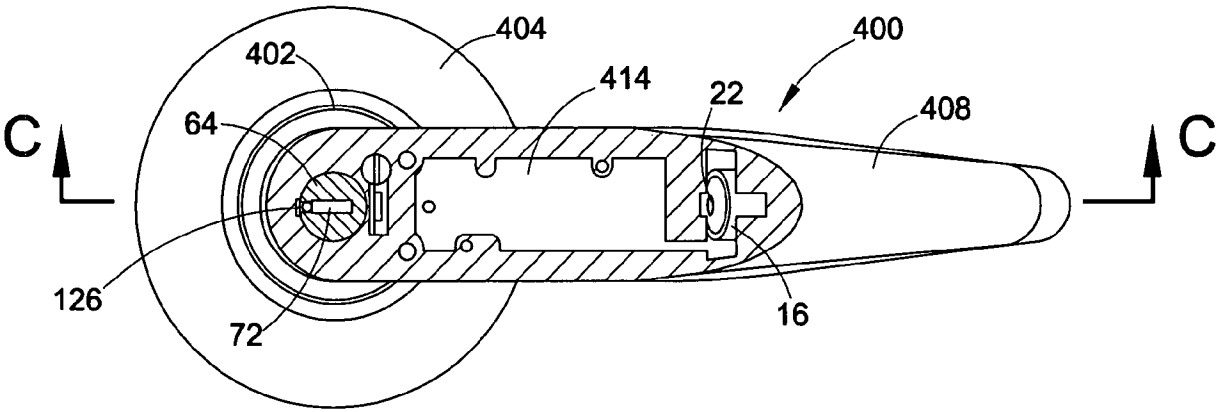
FIG. 7B shows a cross-sectional view of the lever lock embodiment of FIG. 7A, taken along the line A—A in FIG. 7C.
Figure 7C:
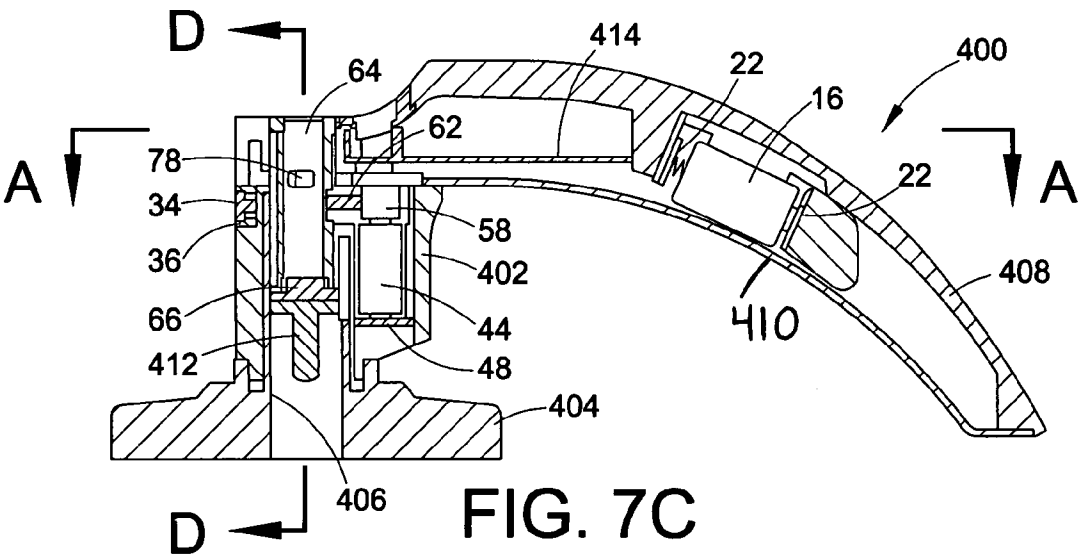
FIG. 7C shows a cross-sectional view of the lever lock embodiment of FIG. 7A, taken along the line C—C in FIG. 7B.
Figure 7D:
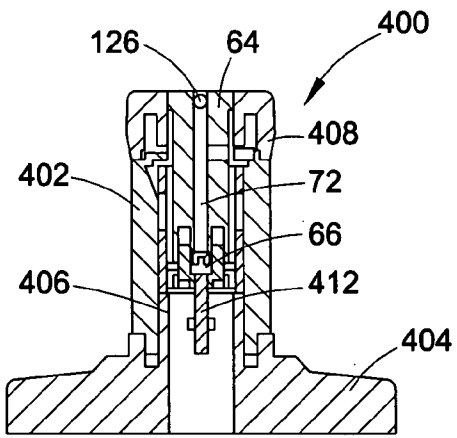
FIG. 7D shows a cross-sectional view of the lever lock embodiment of FIG. 7A, taken along the line D—D in FIG. 7C.
Figure 7E:
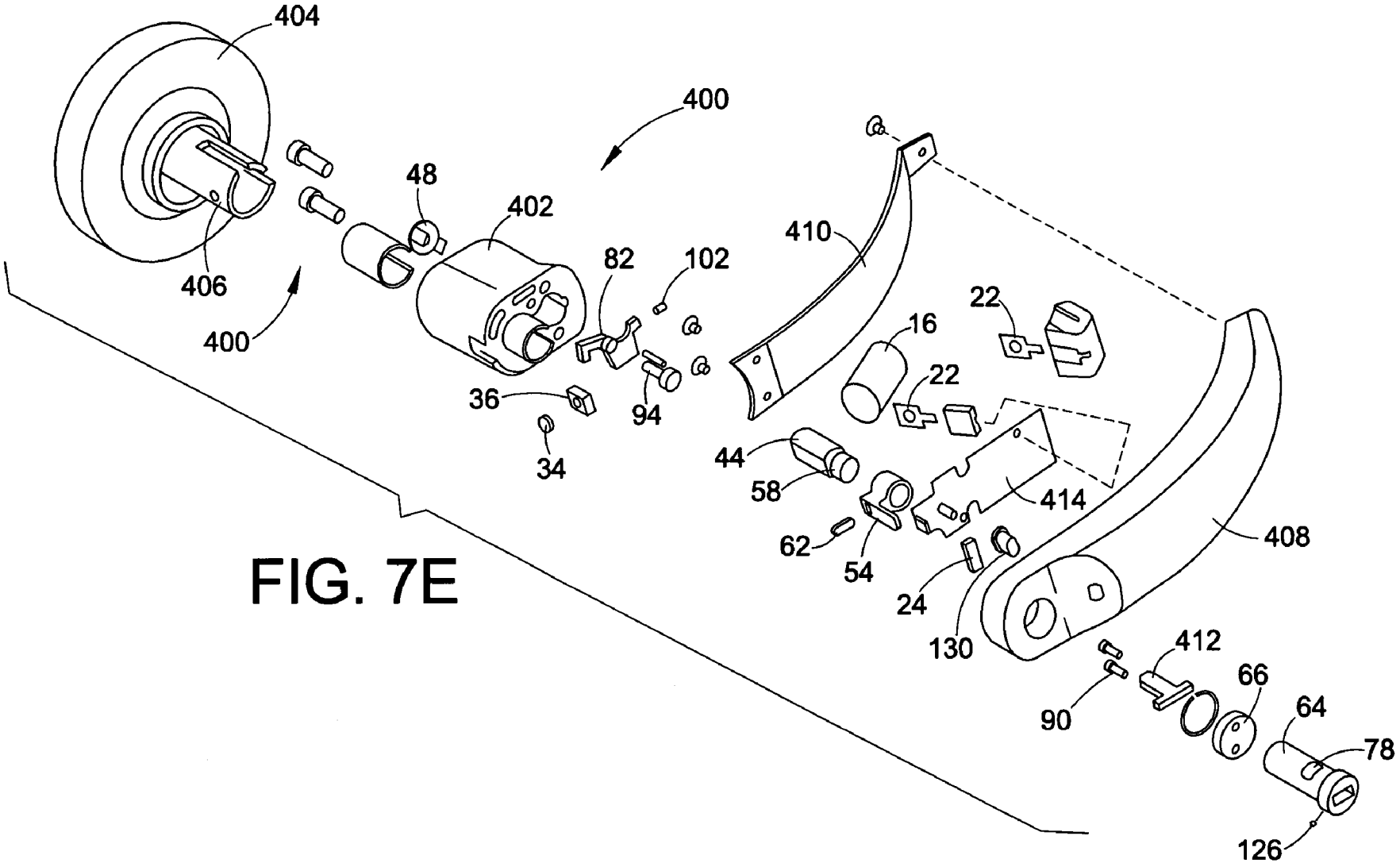
FIG. 7E shows an exploded front, top assembly view of the lever embodiment of FIG. 7A.
Figure 7F:
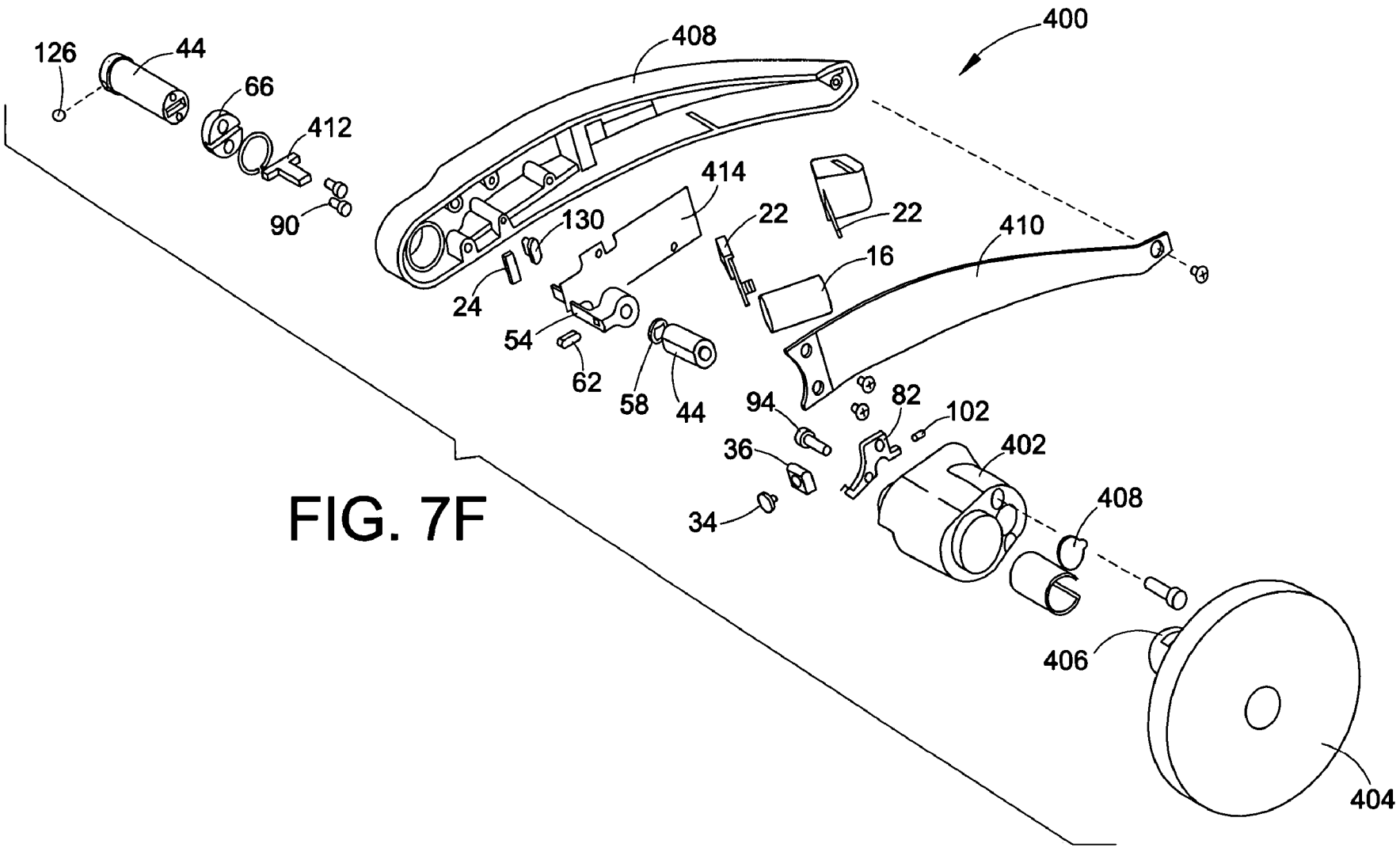
FIG. 7F shows an exploded rear, top assembly view of the lever embodiment of FIG. 7A.

The present invention has at least three different embodiments: a mortise cylinder lock, a padlock, and a lever lock. The present invention also involves an optional programming key for communicating with an RF lock assembly.

A first, and preferred, embodiment of a mortise cylinder lock assembly 10 is shown in FIGS. 1A through 1F. This embodiment 10 can replace an existing mechanical mortise cylinder assembly, without external wiring or significant door modification. The major components of the mortise cylinder lock 10 are a front body 12, a printed circuit board 14, a battery 16, and a rear body 18.

The front body 12 contains the printed circuit board (PCB) 14, the battery 16 and part of the rear body 18. The PCB 14 is secured within the front body 12 between two mounts 20, one on each side of the PCB 14. Two battery contacts 22 are located on top of the PCB 14 to hold the battery 16 and to provide power to those components of the lock assembly 10 requiring power. An RF antenna 23 is mounted to the bottom of the PCB 14. The RF antenna 23 may be any type of device that can receive and/or transmit RF energy, such as an RF choke. When the PCB 14 is installed within the front body 12, the RF antenna 23 is aligned behind a window lens 24 in the front body 12 located above a plug aperture 26. The window lens 24 may be made of almost any nonferrous material for security and protection against external conditions; a ferrous material may interfere with RF transmission. A hard plastic is a preferred material for the window lens 24. The front body 12 is preferably made at least partially of metal, to act as a common ground for the electrical components in the lock assembly 10. Any metal component of the front body 12 may, if desired, be covered by a plastic component to achieve a desired appearance and/or also to help protect against external environmental conditions.

All these internal components may be accessed through a rear opening 28 in the back of the front body 12. A cover plate 30 may be placed over the rear opening 28 to help contain the components in the front body 12, and help protect against entry of external elements such as rain and snow. A gasket 32, preferably made of elastomer or some other effective sealing material, may also be used to help seal against entry of external elements. Also a draining channel may be provided near the bottom of the front body 12 to permit drainage of any moisture which accumulates inside the front body 12.

On the bottom of the front body 12 is an external jumper contact 34, preferably used to provide power to the lock assembly 10 in case the internal battery 16 runs out of power or otherwise fails. The external jumper contact 34 is electrically connected to the PCB 14, and is electrically insulated from the front body 12 by a jumper insulator 36. A standard 9 volt battery may be used to power the lock, by placing the battery's positive terminal on the external battery jumper contact 34 and the battery's negative terminal on the front body 12. Or, as an option, batteries of differing voltage and configuration can be used to externally power the lock assembly 10 by placing the positive terminal on the external jumper contact 34 and placing a metallic connection (such as a paper clip) between the external battery's negative terminal and the front housing 12.

The rear body 18 is generally cylindrical in shape and partially threaded 38 on its exterior surface. It has a top cavity 40 and a bottom cavity 42 extending longitudinally through its body 18. The top cavity 40 contains an electric motor 44 and a blocker assembly 46. The motor 44 is located in the back of the top cavity 40, and is held within the top cavity 40 by a motor backer 48. The motor backer 48 also prevents the motor housing 54 from rotating within the top cavity 40, so that when the motor 44 is powered it rotates the blocker drive 56 (as further discussed below). Electrical wires connecting the motor 44 to the PCB 14 supply power to the motor 44. One end of each wire connects to the PCB 14, and from there the wires extend through a semicircular extension 50 of the top cavity 40 to connect to the back 52 end of the motor 44. A solenoid may be used in place of the motor 44, as would be known to one of ordinary skill in the art.

The motor 44 operates a blocker assembly 46 located in front of the motor 44 in the top cavity 40. The blocker assembly 46 comprises a motor housing 54, a blocker drive 56, a blocker 58, a blocker stop 60, and a sidelock pin 62. The motor 44 rotates the blocker drive 56, which in turn rotates the blocker 58 within the motor housing 54. The blocker 58 is shaped so that when it has not been rotated by the motor 44 it blocks the sidelock pin 62 from moving up and out of the rear body's bottom cavity 42. It is further shaped so that when it has been rotated by the motor 44 the sidelock pin 62 may move up and out of the bottom cavity 42. Operation of the sidelock pin 62 is further described below. The blocker stop 60 extends out of the front face of the blocker 58 to interact with the rim 132 of a cavity in the back of the lever blocker operator 82, as further described below.

The bottom cavity 42 of the rear body 18 contains a plug 64 and a plug extension 66. The bottom cavity 42, unlike the top cavity 40, extends beyond the rear body 18 via a lip 68 extending from the front face 70 of the rear body 18. The plug 64 extends from the front face 70 of the front body 12, through a plug aperture 26 provided in the front body 12, and into the lower cavity 42 of the rear body 18.

The plug 64 is provided with a key slot 72 for receiving a key 74, a top depression 76 for receiving the sidelock pin 62, and a side hole 78 for receiving a bottom extension 80 of a lever blocker operator 82 (all as further described below). The back end 84 of the plug 64 connects to the plug extension 66, which in turn partially extends out of the back opening 86 of the bottom cavity 42. There the plug extension 66 operatively connects to a cam 88. The plug 64, its extension 66, and the cam 88 may be held together by two screws 90. Rotation of the cam 88, if permitted by the lock assembly 10, interacts with hardware in the door to lock and unlock the door.

The lever blocker operator 82 is rotatably mounted to the front face 92 of the rear body 18 via a shoulder screw 94. A bottom extension 80 of the lever blocker operator 82 projects through a hole 95 in the rear body lip 68 and into the side hole 78 of the plug 64. A lever spring 96 wrapped around the shoulder screw 94 biases the lever blocker operator 82 to a "rest position" where its bottom extension 80 projects into the plug side hole 78. A slide actuator 98 may also be housed in the plug side hole 78, to operate in a manner described below. A top extension 100 of the lever blocker operator 82 houses a magnet 102 for operating a Reed switch on the PCB 14, as further described below.

The rear body 18 is attached to the front body 12, preferably such that the front and rear bodies may not thereafter be separated. One of ordinary skill will know of several ways to attach the two bodies, such as by use of two pins 104. These pins 104 may extend through holes 106 in the bottom of the front body 18 and align themselves in slots 108 on the external sides of the rear body lip 68, so that the rear body 18 may not be separated from the front body 12 without first removing the pins 104. The pins 104 are preferably not removable once they have been installed, so that the front and rear bodies may not thereafter be separated.

The pins 104 may be made non-removable in several ways. For example, they may be secured in the front body 12 by twisting a hex wrench inserted into a central hexagonal cavity in the pins 104. The hexagonal cavities may then be stripped after installation so that the pins 104 cannot thereafter be removed with a hex wrench. Alternatively, a press fit grooved pin (for example, as shown in FIG. 1A) may be used. This kind of pin 104 is not removable once it has been inserted.

A key 74 for operating the lock 10 may be provided with a key blade 110, a key PCB 112 and a key RF antenna 114 (similar to the RF antenna 23 in the lock assembly 10). The key PCB 112 has a passive RF identification device, storing identification information for verification by the PCB 14 in the front body 12. The key RF antenna 114 should be positioned so that, when the key blade 110 is fully inserted in the key slot 72 of the plug 64, the key RF antenna 114 will be sufficiently close to the RF antenna 23 in the front body 12 to permit effective communication between the RF antennas. The distance between RF antennas is preferably less than or equal to 10 millimeters (mm), more preferably less than or equal to 7 mm, and most preferably less than or equal to 5 mm. The key PCB 112 and key RF antenna 114 are preferably housed in a plastic key grip portion 116 attached to a metal key blade 110 or head 118.

These keys 74 may be specially manufactured. They may also be made by modifying pre-existing mechanical keys. Preferably, such modification is performed by mounting on to the head 118 of the key 74 an outer covering 116 containing the key PCB 112 and key RF antenna 114. The mounting may be achieved, for example, by using adhesives, a snap-on arrangement between separate covering parts, or a combination thereof. Spacers 120 may be inserted into the key slot, if needed, to achieve a good fit with pre-existing mechanical keys.

The mortise lock assembly 10 operates in the following manner. First it is installed on a door. Installation is achieved by screwing the threaded portion 38 of the rear body 18, already attached to the front body 12, into a threaded receptacle in the door. The forming of such a receptacle in the door will be known to a person of ordinary skill in the art. The rear body 18 may be sized to replace a standard-sized mechanical mortise cylinder already being used in a door. This would allow customers to replace a mechanical lock cylinder with an electronic lock assembly 10 by simply drilling a hole in the door for receiving a security bolt, as described below.

The rear opening 28 of the front body 12 should be flush against the front of the door. A spacer member 122 may be inserted between the front body 12 and the door to achieve a sufficient fit. To prevent an intruder from unscrewing the lock assembly 10 from the door, a threaded hole 124 is provided in the back of the front body 12, near the top, for receipt of a threaded security bolt (not shown in the drawings). The security bolt is inserted into the back of the door, through a hole in the door placed to correspond to the threaded hole 124 in the back of the front body 12, and screwed into the front body 12. The security bolt prevents rotation of the lock assembly 10 by a person on the outside of the door.

Before insertion of a key 74, rotation of the plug 64 is prevented by two things: (A) the bottom extension 80 of the lever blocker operator 82 extending into the side hole 78 of the plug 64, and (B) the sidelock pin 62 extending into the top depression 76 in the plug 64. In this configuration the electronics are in "sleep" mode: very little power, and preferably no power, is being consumed.

When a key blade 110 is inserted into the key slot 72 of the plug 64, the slide actuator 98 is pushed aside. The slide actuator 98 in turn pushes the bottom extension 80 of the lever blocker operator 82 out of the plug side hole 78, removing rotation restriction A. This causes the lever blocker operator 82 to rotate against the bias of the lever spring 96. The magnet 102 in the lever blocker operator 82 is thus positioned next to a Reed switch on the PCB 14 in the front body 12, activating the electrical system. The Reed switch is a preferred embodiment. The switching mechanism may be solely mechanical in nature, or be any type of switch of a suitable size for fitting in the front body 12. One of ordinary skill in the art will know of such switches. Activation of the switch places the electronics in "wake-up" mode, so that power is supplied to the electronic circuitry in the front body, which in turn powers the RF antenna 23 in the lock assembly 10.

The RF antenna 23 in the front body 12 in turn provides power to the key PCB 112 and key RF antenna 114 via RF coupling with the key RF antenna 114. Such RF coupling may occur, for example, through an inductive coupling between the antennas. The identification information stored in the key PCB is communicated via RF coupling to the PCB in the front body. RF data received by the PCB 14 is demodulated and sent to a micro-controller in the PCB 14. The micro-controller extracts a coded key identifier. The micro-controller will compare the key identifier with stored data indicating what identification is required for access, and then admit or deny entry depending upon whether the information matches.

One of ordinary skill will understand that several variables may be used to determine whether the key's identification information authorizes access. Such access may be tied to the particular key (i.e., is that key a proper key for access?); date and time (i.e., the key may be authorized for access only on certain days and/or only at certain times); number of times access is allowed (for example, a key may be programmed to permit one time access to a lock, and thereafter not be useable); or any other variable desired.

A typical application would be if the lock assembly 10 were preprogrammed to permit access only upon insertion of an appropriate key with the required identification information. In this situation, the micro-controller will search through its internal memory for a match between the key identifier and its stored identifiers permitting access. If a match is found the micro-controller executes a passed response function, and permits the lock to be unlocked. If no match is found the micro-controller executes a failed response function, and does not permit the lock to be unlocked.

Another application would be if the lock assembly 10 were preprogrammed to permit access only upon insertion of an appropriate key with the required identification, at the right time. In this situation, the micro-controller will search through its internal memory for a match between identification information. If an identification match is found, the micro-controller further evaluates access by comparing real time, day, month and year read from an internal clock. If both a key identification and time window matches are found, the micro-controller executes a passed response function. If either the key identification or the time window does not match, the micro-controller executes a failed response function.

When executing a passed response, the micro-controller will test if the battery 16 voltage is too low. If the battery 16 voltage is low, the micro-controller may notify the user, for example by causing an LED 130 to blink a specified number of times. The micro-controller preferably then charges a capacitor bank disposed in the front body 12. When the voltage across the capacitor reaches a preset voltage, the micro-controller stop charging the capacitor bank directs the charged energy to the motor for unlocking the lock 10. This energy can be used to activate any electromechanical device in order to open or unlock a device.

If access is properly authorized, the front body PCB 14 transfers power to the motor 44. The motor 44 turns the blocker 58, permitting the sidelock pin 62 to move out of the top depression 76 in the plug 64. Thus rotation restriction B is removed, and the plug 64 is free to rotate within the bottom cavity 42 of the rear body 18. The user rotates the key 74, thus rotating the plug 64 and cam 88, to unlock the door. As shown in the drawings, a ball bearing 126 stored within the front rim 128 of the plug 64 holds the key blade 11O within the plug 64 for all orientations except where the two RF antennas are aligned. In that orientation, the sidelock pin 62 is aligned with the top depression 76 in the plug 64.

When executing a failed response, the micro-controller will indicate to the user that access is denied, for example by causing an LED 130 to blink once. The micro-controller then enters back into a low power sleep mode.

An indicator may be provided to relay various kinds of information to the keybearer, for example whether access is granted or denied. Such an indicator may communicate visually, aurally, or tactilely. Preferably an LED 130 is used for this purpose. Such an LED 130 may be electrically connected to the PCB 14, and housed within a light pipe for transmitting the light to a window 132 in the front body 12. The LED 130 may emit just one color of light, and convey information by various blinkage sequences. Or, it may emit two or more colors of light, for example green for "access granted" and red for "access denied." It may further indicate if an error has occurred, or if the internal battery 16 is getting weak. Alternatively, a sound indicator (such as a speaker) or a vibration indicator may be used.

After access is granted the keybearer opens the door and removes the key 74 from the key slot 72. The bias of the lever spring 96 causes the lever blocker operator 82 to rotate back to its rest position, with its bottom extension 80 projecting into the plug side hole 78 (displacing the slide actuator 98 in the process). The Reed switch is thus deactivated, so the PCB 14 no longer supplies power to any of the assembly components. At the same time, the rim 132 in the back of the lever blocker 82 operator defined by the cavity there interacts with the blocker stop 60. The rim 132 is shaped so that as the lever blocker operator 82 rotates back to its the rest position, the blocker stop 60 is forced to rotate as well. The blocker stop 60 in turn rotates the blocker 58 back to its initial position, forcing the sidelock pin 62 back down into the top depression 76 of the plug 64. In this manner rotation restrictions A and B are both put back into place when the key 74 is removed from the key slot 72.

A second embodiment 10' of a radio frequency mortise cylinder lock is shown in FIGS. 2A through 2E. This second embodiment operates substantially the same as the first mortise cylinder embodiment 10, described at length above, with a few differences. Like elements use the same reference numerals as in FIGS. 1A through 1F. Differences from the first embodiment 10 include, first, in place of the lip extending from the front face 135 of the rear body 18, a front mortise body 136 is employed. The front mortise body 136 is inserted into an aperture 138 in the front body 12, and it rotatably holds the front portion of the plug 64. It also provides the lens window 24 used for communication between RF antennas in the front body 12 and the key 74.

Second, the LED 140 is located directly on the PCB 14 in the front body 12. The LED 130 projects through an LED aperture 142 in the front face 135 of the front body 12.

Third, the external jumper contacts are configured differently from the first mortise cylinder embodiment 10. In the second embodiment 10' the contacts comprise two levers 144*a* and 144*b* which are rotatably mounted to the bottom 146 of the front body 12. A first lever 144*a* provides an electrical connection to the PCB 14, preferably via a jumper power contact 147 which is electrically insulated from metal components in the front body 12. Such insulation is preferably achieved with plastic. A second lever 144*b* provides a ground connection to the metal in the front body 12, preferably via a jumper ground contact 149. When opened, the space between the levers allows connection to an external battery, preferably a CR2 type battery. The levers 144*a* and 144*b* may be symmetrical, to reduce manufacturing costs. When not in use the levers may be closed to help protect against external environmental conditions.

Fourth, the blocker assembly of the second mortise cylinder embodiment 10' is substantially different from the first embodiment 10. The second embodiment's blocker assembly comprises a blocker housing 148, a blocker 150, a sidelock pin 152 and spring 154, a blocker ball 156 and spring 158, and a block stop pin 160. The blocker 150 is housed in a bore 161 of the blocker housing 148, which may be secured to the motor 44 with two screws 162 via screw receptacles 163.

In the locked position, rotation of the plug 64 is prevented by interference between the top depression 76 in the plug 64 and the sidelock pin 152. The sidelock pin 152 is normally forced down into the top depression 76 by the sidelock spring 154 and the blocker 150, and may move up out of the top depression 76 only when the blocker 150 is rotated by the motor 44. When such blocker 150 rotation occurs, a clearance pocket 164 in the blocker 150 aligns with the sidelock pin 152 extending through a cavity 165 in the blocker housing 148. In that configuration rotation of the plug 64 may push the sidelock pin 152 out of the top depression 76, against the downward bias of the sidelock spring 154.

The blocker 150 further has a track 166 with two pockets 168*a* and 168*b*, one pocket for each of the two détente positions (locked and unlocked). The blocker ball 156 and spring 158 located in a hole 174 of the blocker housing 148 interact with the two pockets 168*a* and 168*b* to retain the blocker 150 in the locked or unlocked position. A pin shaped protrusion 174 from the blocker 150 interacts with a cavity rim 132 in the back of the lever blocker operator 82 to return the blocker assembly to its locked position once the key 74 is removed.

The blocker assembly may have an entirely separate structure from the track 166 to prevent over-travel. For example, two stop positions 176*a* and 176*b* may interact with a blocker stop pin 160 in a slot 178 of the blocker housing 148 to prevent the blocker 150 from rotating further than its two détente positions.

The major differences between the two mortise cylinder embodiments 10 and 10' described above lead to several structural differences in the shape and configuration of the various lock assembly components. All of these structural differences will be understood upon viewing the drawings.

The PCB 14 in the front body 12 may be configured to record an audit trail of access attempts. For example, it may record the identification information received from each key 74 used to attempt access; the date and time of each attempt; whether or not access was granted; and other information.

A special programming key may be used to exchange information between lock PCBs 14 and a personal computer. This is especially useful where several RF locks 10 are used as part of an overall security system, for example throughout an entire building or campus of buildings. In that type of environment the management of which key(s) 74 are authorized for access to which lock(s) 10 can be a significant burden. The programming key greatly alleviates that burden.

The programming key may, for example, be used to update a lock PCB's 14 database of keys 74 which should be authorized for access, the dates and times of permitted access, and other such variables. It may also download the audit information stored by the lock's PCB 14 for transfer to and storage by the personal computer. A preferred embodiment of a programming key 200 is shown in FIGS. 5A through 5E.

The preferred programming key embodiment 200 comprises a base unit 202 and a mobile key unit 204. The base unit 202 has a receptacle 206 for receiving the mobile key unit 204. While in the base unit 202 the mobile unit 204 may communicate with the personal computer via a wired connection 208 or a wireless connection. Thus audit information stored in the mobile unit 204 may be downloaded to the personal computer. Similarly updated identification information for distribution to several locks 10 in a system may be uploaded to the mobile unit 204.

The base unit 202 also may have a receptacle 210 for receiving standard keys 74 used in the system. A base RF antenna 212 in the base unit 202 communicates with the key RF antenna 114. The communication may be read-only, whereby information passes only from the key PCB 114 to the base unit 202. In that embodiment several pre-programmed keys 74 are purchased from the manufacturer. When an individual key 74 is given to a new user, its identification information is first read by the base unit 202 and sent to the personal computer. That information is then downloaded to the mobile unit 204 for addition to all the locks 10 the new user has permission to access. The read process may also be used to verify a key's identification information.

Alternatively, the communication may be read-write. In this embodiment the base unit 202 may read information from the key 74, as just described. It may also, however, program or change identity information stored in a standard key PCB 112. This adds flexibility to the lock system.

The mobile key unit 204 comprises a main housing 214 connected by a tether 216 to a key housing 218. The tether 216 permits information to be communicated between the main housing 214 and the key housing 218. Separating these two units reduces the weight of the portion 218 inserted into an RF lock assembly 10, thus reducing stress in the system. A clip 220 and a receptacle 222 for the key housing 218, each located on a side of the main housing 214, provide an easy means for carrying the mobile key unit 204 as the user travels between locks 10 on a programming/auditing run.

The main housing 214 may include various indicators for communicating status to the user. For example, the embodiment of FIGS. 5A through 5E has a "Power/Low Battery" light 224 for indicating when the mobile key 218 has been turned on, or when battery 16 power is running low. It also has a "Memory Full" light 226 which indicates when the user should return the mobile unit 204 to the base 202 for communicating with the personal computer, for example when the mobile unit's memory is full or when an error has occurred. The "Communicating" light 228 indicates when the mobile unit 204 is communicating with a lock PCB 14 or the base unit 202. Alternative indicators include an LCD screen, an aural indicator, a tactile indicator, and any other indicator known to one of ordinary skill in the art.

The mobile key housing 225 may hold a key blade 226, a key PCB 228 and a key RF antenna 230. The key blade 226 is inserted into the key slot 72 of a mortise cylinder lock/padlock/lever lock for communicating with the lock's PCB 14. It may further include one or more indicators, as already described for the main housing 214. It may be preferred to provide the indicators on the key housing 218, rather than the main housing 214, or on both housings, depending upon the user who will be using the programming key 200.

The mobile key 204 may be powered by any method known to one of ordinary skill in the art. This includes use of a standard battery 232, for example the 9 Volt battery shown in FIG. 5. Power may also be supplied via a permanent or replaceable rechargeable battery in the mobile unit 204, charged when the mobile unit 204 is placed in the base 202. Similarly a capacitor or super capacitor may be used, the latter being preferred due to its larger capacity. Power may alternatively be supplied by a combination of these elements. Other methods will be known to one of ordinary skill in the art. An indicator on the base unit 202 or the mobile unit 204 may indicate when recharging is occurring; preferably an LED 130 is used for this purpose.

Having described the two preferred mortise cylinder embodiments 10 and 10', padlock and lever lock embodiments are now described. A preferred padlock embodiment 300 is shown in FIGS. 6A through 6H. Like elements use the same reference numerals as in FIGS. 1A through 1F, and the operate in a substantially similar way. Instead of a front and rear housing, a padlock body 302 houses a mount 304 on which the various components are mounted. When the plug 64 is freed to rotate by the motor 44, rotation of the plug 64 rotates cam 306 so that ball bearings 308 may be freed from detents 310 in the hook member 312. A base plate 314 holds the components within the padlock body 302.

A preferred lever lock embodiment 400 is shown in FIGS. 7A through 7F. Like elements use the same reference numerals as in FIGS. 1A through 1F, and the operate in a substantially similar way. Instead of a front and rear housing, a lever body 402 fits over a cylinder 406 in a lever base 404. A lever 408 with a rear plate 410 is connected to the end of the lever body 402 opposite the lever base 404. The positive terminal from the battery 16 is connected to the PCB 14 via a conductor 414. When the plug 64 is freed to rotate by the motor 44, rotation of the plug 64 rotates cam 412 so that the lever body 402 and lever 408 are freed to rotate about the cylinder 406. Thus the lock assembly 400 is unlocked.

While the present invention has been illustrated by the description of embodiments thereof, it is not the applicants' intention to restrict or in any way limit the scope of the appended claims to such detail. Additional advantages and modifications will readily appear to those skilled in the art. Therefore, the invention in its broader aspects is not limited to the specific details, representative structure and method, or illustrative examples shown and described. Accordingly, departures may be made from such details without departing from the spirit or scope of the applicants' general inventive concept.

We claim:

1. A lock and key assembly comprising a front body, a rear body and a key, the front body containing a printed circuit board, a battery electrically connected to the printed circuit board, a lock radio frequency antenna operatively connected to the printed circuit board, and a window in front of the lock radio frequency antenna, the rear body having a first cavity which rotatably receives a plug such that the plug is operatively connected to a cam, and the cam interacts with hardware in a door for locking and unlocking the door, the key comprising a passive radio frequency identification device, a key radio frequency antenna, and a key blade, the plug having a key slot for receipt of the key blade such that when the key blade is inserted into the key slot the distance between the lock radio frequency antenna and the key radio frequency antenna is sufficiently small to permit communication, the rear body having a second cavity housing a motor and a blocker, the motor being electrically connected to the printed circuit board such that when power is provided to the motor, the motor rotates the blocker from a locked position to an unlocked position, a lever blocker operator movably mounted within the front body such that the lever blocker operator has a sleep position and a wake-up position, wherein in the sleep position the lock and key assembly consumes very little or no power, and in the wake-up position power is supplied to the printed circuit board, such that when the key blade is inserted into the key slot the lever blocker operator is moved from the sleep position to the wake-up position, wherein when the blocker is in the locked position the blocker prevents displacement of a sidelock pin from a depression in the plug, and when the blocker is in the unlocked position the blocker does not prevent displacement of the sidelock pin from the depression, and wherein the lever blocker operator is rotatably mounted within the front body.

2. The lock and key assembly of claim 1 further comprising an external jumper contact for providing electrical power to components in the assembly which use electrical power.

3. The lock and key assembly of claim 2 further comprising an LED electrically connected to the printed circuit board, the LED operating to communicate to the keybearer whether access is granted or denied by the lock assembly.

4. The lock and key assembly of claim 1 further comprising a lever spring which biases the lever blocker operator in the sleep position, and insertion of the key blade into the key slot moves the lever blocker operator against the bias of the spring from the sleep position to the wake-up position.

5. The lock and key assembly of claim 4 wherein, when the key blade is removed from the key slot, the spring causes the lever blocker operator to move from the wake-up position to the sleep position.

6. The lock and key assembly of claim 1 wherein when the key blade is inserted into the key slot the distance between the lock radio frequency antenna and the key radio frequency antenna may be less than or equal to 10 millimeters.

7. The lock and key assembly of claim 6 wherein when the key blade is inserted into the key slot the distance between the lock radio frequency antenna and the key radio frequency antenna may be less than or equal to 7 millimeters.

8. The lock and key assembly of claim 7 wherein when the key blade is inserted into the key slot the distance between the lock radio frequency antenna and the key radio frequency antenna may be less than or equal to 5 millimeters.

9. The lock and key assembly of claim 1 wherein the lock and key assembly comprises a mortise cylinder lock assembly.

10. The lock and key assembly of claim 1 wherein the passive radio frequency identification device stores information indicating the person to whom the key was given is authorized for access.

11. A passive radio frequency lock comprising:

a lock assembly including a plug, a lock printed circuit board, a lever blocker operator, and a slide actuator, such that:

the plug includes a key slot and an aperture defined between the key slot and an exterior of the plug, the slide actuator is positioned within the aperture of the plug, the lever blocker operator is positioned to contact the slide actuator, the lever blocker operator is mounted to move between a sleep position and a wake-up position, and the lock printed circuit board includes a switch to change the lock printed circuit board between a sleep mode and a wake-up mode;

a key including a key blade insertable into the key slot;

wherein when the key blade is not inserted in the key slot, the slide actuator extends into the key slot and the lever blocker operator is in the sleep position, but when the key blade is inserted into the key slot, it displaces the slide actuator from the key slot and the lever blocker operator is moved to the wake-up position; and wherein when the lever blocker operator is in the sleep position, the switch is not activated and the lock printed circuit board is in the sleep mode, but when the lever blocker operator is in the wake-up position, the switch is activated and the lock printed circuit board is in the wake-up mode.

12. The passive radio frequency lock of claim 11, the lock assembly further comprising a power source, wherein when the lock printed circuit board is in the sleep mode, the lock printed circuit board does not receive power from the power source, but when the lock printed circuit board is in the wake-up mode, the lock printed circuit board receives power from the power source.

13. The passive radio frequency lock of claim 12, the key further comprising a key printed circuit board and a key radio frequency antenna, such that:

the key printed circuit board is operatively connected to the key radio frequency antenna, and the key printed circuit board changes between an inactive mode and an active mode;

wherein when the key is inserted in the key slot and the lock printed circuit board is in sleep mode, the key printed circuit board is in inactive mode, but when the lock printed circuit board is in wake-up mode, the key printed circuit board is in active mode and receives power through radio frequency coupling between the lock radio frequency antenna and the key radio frequency antenna.

14. The passive radio frequency lock of claim 11, further comprising a LED electrically connected to the lock printed circuit board.

15. The passive radio frequency lock of claim 11, further comprising an external jumper contact for connecting an auxiliary supply of power.

16. The passive radio frequency lock of claim 11, wherein the lever blocker operator is rotatably mounted.

* * * * *